US007621398B2

(12) United States Patent
Sugibuchi

(10) Patent No.: US 7,621,398 B2
(45) Date of Patent: Nov. 24, 2009

(54) PORTABLE HOUSING CONTAINER

(75) Inventor: Takashi Sugibuchi, Kanagawa Prefecture (JP)

(73) Assignee: 3M Innovative Properties Company, St. Paul, MN (US)

( * ) Notice: Subject to any disclaimer, the term of this patent is extended or adjusted under 35 U.S.C. 154(b) by 239 days.

(21) Appl. No.: 11/733,966

(22) Filed: Apr. 11, 2007

(65) Prior Publication Data

US 2008/0251404 A1 Oct. 16, 2008

(51) Int. Cl.
*B65D 85/48* (2006.01)
*B65D 73/00* (2006.01)
*G09F 7/00* (2006.01)

(52) U.S. Cl. ..... 206/450; 206/472; 206/449; 40/492

(58) Field of Classification Search ..... 206/45.23, 206/449, 450, 472, 494, 232; 40/726, 729, 40/733, 793, 492; 229/92.8, 87.5
See application file for complete search history.

(56) References Cited

U.S. PATENT DOCUMENTS 739,754 A * 9/1903 Lovece ..... 150/133
1,580,346 A * 4/1926 Sutter ..... 150/132
1,833,881 A * 11/1931 Hughes ..... 150/132
2,320,006 A * 5/1943 Moore ..... 229/120.09
2,367,381 A * 1/1945 Szymlek ..... 40/729
D264,022 S * 4/1982 Wayman ..... D3/247
5,215,398 A 6/1993 White et al.
5,701,696 A * 12/1997 Clontz ..... 40/642.02
6,276,414 B1 * 8/2001 Bibb ..... 150/132
6,886,685 B2 * 5/2005 Slater ..... 206/215

FOREIGN PATENT DOCUMENTS

GB 2372959 A * 9/2002
JP 2-144465 12/1990
JP 9-301471 11/1997
JP 11-203261 1/1999

* cited by examiner

*Primary Examiner*—Mickey Yu
*Assistant Examiner*—Melissa L Lalli
(74) *Attorney, Agent, or Firm*—Robert H. Jordan

(57) ABSTRACT

The portable housing container is of the front and rear side opening type. When one side of the housing container is opened so that the first edge of the first plate may be separated from the third edge of the second plate, the first housing recess of the first plate appears and stacks of tags or memo papers housed therein can be dispensed. Similarly, when the other side of the housing container is opened so that the second edge of the first plate may be separated from the fourth edge of the second plate, the second housing recess of the second plate appears. If different types of stacked sheets are housed, respectively, in the first housing recess and the second housing recess, the different types of sheets can be carried.

7 Claims, 23 Drawing Sheets

PORTABLE HOUSING CONTAINER

FIELD OF THE INVENTION

The present invention relates to a portable housing container. More specifically, the present invention relates to a portable housing container useful for carrying stacks of sheets.

BACKGROUND

A certain housing container for small paper pieces is disclosed in Japanese Published Patent Application Hei 11-20361 (JP1120261A). The housing container as disclosed in this publication is provided with a retainer that is detachably attached to the ring of a binder for use. In the retainer made from synthetic resin by integral molding, an outer frame and an inner frame, both of which protrude from a sheet body, are formed; and the sheet body is sectioned by the outer frame and the inner frame, in cooperation, so as to construct three levels of housing compartments. Laminates of small-sized tags are housed in the first level from the top, laminates of medium-sized tags are housed in the second level, and laminates of large-sized tags are housed in the third level. Adhesive is also applied to the rear surfaces of tags. The housing container allows tags to be housed according to their types in an easily distinguishable manner, as well as allows their remaining quantities to be identified at a glance.

The housing container in JP1120261A, however, is not equipped with a lid, and thus, the tags are exposed by an open portion from which they are taken out. Therefore, where the housing container is used, there is a concern that the tags may carelessly be stained, collect dirt particles, become damaged and/or creased while the container is being carried. Also, if memo papers are housed in the housing container, there is concern that similar incidents are likely to happen.

A tag holder is available on the market that is arranged to sandwich tags between a front cover sheet and a back cover sheet. This tag holder is portable while being inserted in a pocket book. The tags in the holder are affixed to the inner side of the back cover sheet and thus are protected by both the front cover sheet and the back cover sheet.

SUMMARY OF THE INVENTION

The present invention provides a housing container that has excellent portability in carrying stacks of tags or memo papers.

In accordance with the present invention, there is provided a portable housing container comprising: (1) a first plate having a first housing recess, the first plate having opposing first and second edges; (2) a second plate having a second housing recess, the second plate having a third edge facing the first edge of the first plate and a fourth edge facing the second edge of the first plate; and (3) a first connecting member, a second connecting member and a third connecting member for connecting the first plate and the second plate, each connecting member being disposed between the first plate and the second plate, wherein the first connecting member and the second connecting member are bridged between the first edge of the first plate and the fourth edge of the second plate, and the third connecting member, while being disposed between the first connecting member and the second connecting member, is bridged between the second edge of the first plate and the third edge of the second plate.

The portable housing container can be of the front and rear side opening type. When one side of the housing container is opened so that the first edge of the first plate may be separated from the third edge of the second plate, the first housing recess of the first plate appears and stacks of tags or memo papers housed therein can be dispensed. Similarly, when the other side of the housing container is opened so that the second edge of the first plate may be separated from the fourth edge of the second plate, the second housing recess of the second plate appears and the stacks of tags or memo papers housed therein can be dispensed. Thus, if different types of stacked sheets housed, respectively, in the first housing recess and the second housing recess, the different types of sheets can be carried. In addition, there will be no incidents of the tags' being carelessly stained, collect dirt particles, become creased and/or damaged while being carried. Further, the housing container of the front and rear side opening type can be attained from a simple construction and can easily be made compact and light-weight.

The first and second plates can be substantially identical in shape. This will enable users to hold the portable housing container with ease.

The third connecting member can be present to extend as if to hang over the first and second housing recesses. The first and second connecting members, which are disposed at both sides of the third connecting member, can extend without protruding from the first and second plates so that they do not hang over the first and second housing recesses. This construction will secure sufficient opening areas of the first and second housing recesses while not being obstructed by the first and second connecting members.

The first and second plates can be rectangles in shape. A connecting sheet having the first, the second and the third connecting members, in an extended configuration thereof, comprises: a first half sheet portion comprising the third connecting member of a rectangular shape, a first and a second affixing sections elongating along a first and a second peripheries of the third connecting member that are parallel and opposed to each other, and a third affixing section for connecting the first and second affixing sections, the third affixing section disposed along a third periphery between the first periphery and the second periphery; and a second half sheet portion comprising a fourth affixing section disposed along a fourth periphery between the first periphery and the second periphery, the first and second connecting members disposed in the same direction as the first and second affixing sections, the connecting members being attached to the ends of the first and second affixing sections at one ends thereof, and a fifth and a sixth affixing sections being attached to the other ends of the first and second connecting members, wherein slits are made between the third connecting member and the first affixing section, between the third connecting member and the second affixing section, between the first connecting member and the fourth affixing section, and between the second connecting member and the fourth affixing section. Because the connecting sheet to be used has such construction, the number of parts can be reduced leading to a streamlined, cost-effective, manufacturing process.

The first and second housing recesses can be rectangles in shape. A housing recess adapted for rectangular tags or memo papers can be attained.

The second plate can detachably be bound with the first plate by a binding means. The first and second plates can be arranged such that the space therebetween is not opened carelessly while they are being carried. The binding means include, but are not limited to, a magnet, a hook-and-loop fastener, a reusable or repositionable adhesive allowing for repeated attachment and release, a band, a means relying on concavity-convexity fittings, and the like. The binding means can be applied to secure the first and second plates 2, 3 in a closed configuration during transport.

Stacks of sheets include, but are not limited to, paper that can be housed within the first and second housing recesses.

The stacks of sheets can also be fixed to the front and/or the rear surface of the third connecting member. Each stack is spaced apart from other stacks within the housing recesses and can be stored in the housing container. Therefore, different types of stacked sheets can be used.

Each sheet in the stack may have adhesive applied to its rear surface. The sheets may be stacked so that all the adhesive are aligned at one end. In an alternate embodiment, the sheets are stacked such that the adhesive alternate at opposite ends of the stack, forming a fan-fold or "z-stacked" configuration. In this document, the term "about" is presumed to modify all numerical dimensional values.

BRIEF DESCRIPTION OF THE DRAWINGS

The invention can be better described with reference to the drawings, wherein.

While the above-identified drawings set forth several embodiments of the invention, other embodiments are also contemplated, as noted in this document. In all cases, this disclosure presents the invention by way of representations and not limitation. Numerous other modifications and embodiments can be devised by one skilled in the art which fall within the scope and spirit of the principals of this invention. The figures are idealized, are not drawn to scale, and are intended merely for illustrative purposes. Like reference numbers denote like elements of the various embodiments.

DESCRIPTION OF THE PREFERRED EMBODIMENTS

Exemplary embodiments of the portable housing container in accordance with the present invention will be described in detail by reference to the drawings hereafter.

Figure 1:
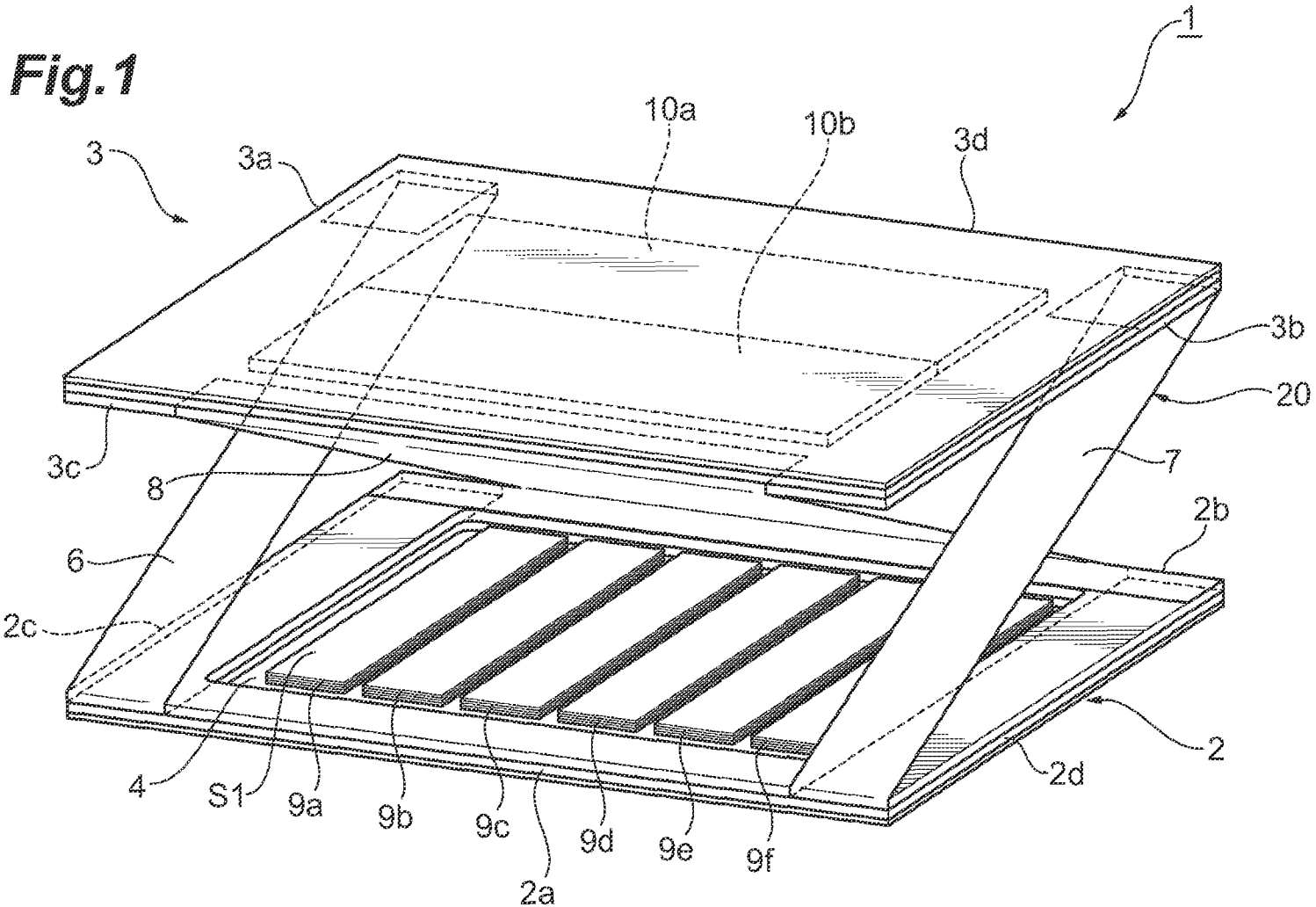
FIG. 1 is a perspective view of a portable housing container in accordance with a first embodiment of the present invention.
Figure 2:
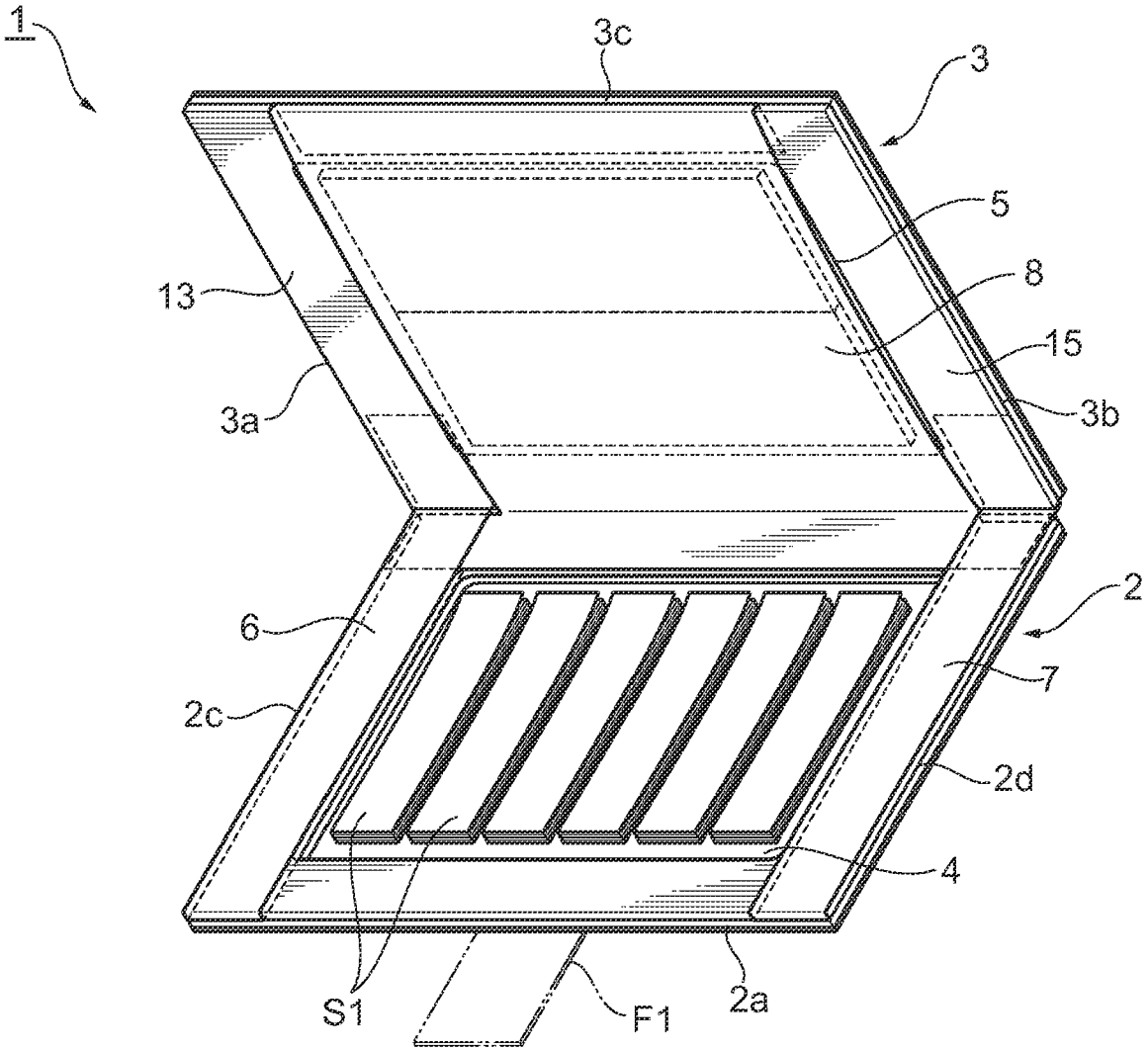
FIG. 2 is a perspective view of the portable housing container of FIG. 1 showing its configuration as being opened from a first side.
Figure 3:
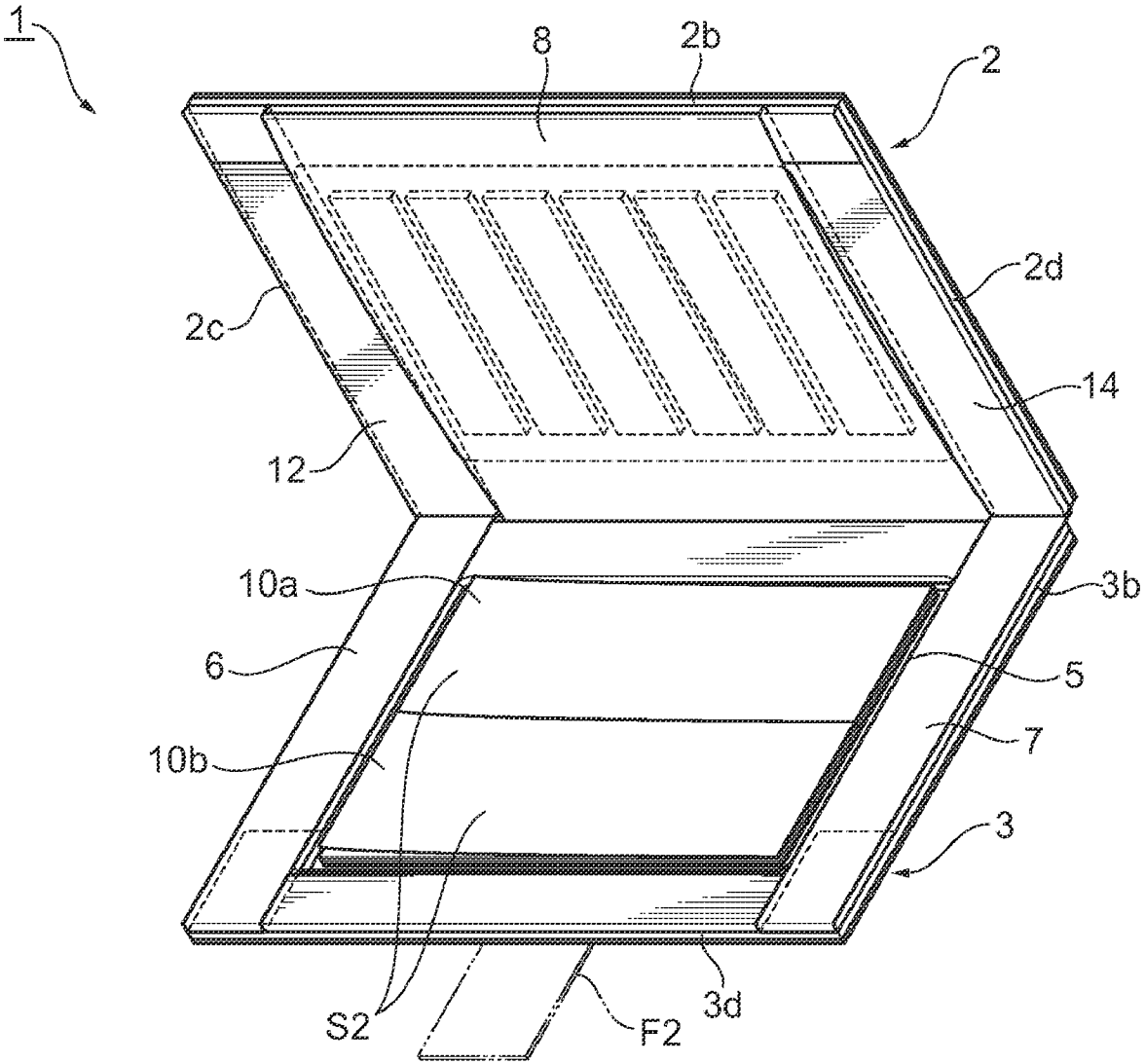
FIG. 3 is a perspective view of the portable housing container of FIG. 1 showing its configuration as being opened from a second side.

A first embodiment of a portable housing container according to the invention is illustrated in FIGS. 1-11. As shown in FIGS. 1-3, a portable housing container 1 of a front and rear side opening type has a first plate 2 and a second plate 3. In one embodiment, both plates can be made from 2 mm thick substrate, such as, but not limited to, synthetic resin or stiff paper. The geometry of the first and second plates 2, 3 is substantially rectangles. The dimensions of the first and second plates 2, 3 can be, but are not limited to, 10 cm by 7 cm. The first plate 2 includes a first housing recess 4. The second plate 3 includes a second housing recess 5. The first and second housing recesses 4, 5 have substantially similar shapes, each being a substantially rectangular opening of, for example but not limited to, 8 cm by 5.5 cm. Referring to the first and second plates 2, 3, there are no particular limitations to the widths of peripheral surfaces of the first and second housing recesses as long as they provide adequate strength to the container. The width of the peripheral surface may range from 5 to 15 mm.

The first plate 2 includes opposing first edge 2*a* and second edge 2*b* at the linear long side, and opposing third edge 2*c* and fourth edge 2*d* at the linear short side. Similarly, the second plate 3 includes opposing first edge 3*a* and a second edge 3*b* at the linear short side, and opposing third edge 3*c* and fourth edge 3*d* at the linear long side. When the first housing recess 4 of the first plate 2 faces the second housing recess 5 of the second plate 3, the first edge 2*a* of the first plate 2 lies substantially face to the third edge 3*c* of the second plate 3 and the second edge 2*b* of the first plate 2 lies substantially face to the fourth edge 3*d* of the second plate 3.

In this embodiment, the first and second plates 2, 3 are connected by a first connecting member 6, a second connecting member 7 and a third connecting member 8. The first, second and third connecting members 6, 7, 8 are disposed between the first plate 2 and the second plate 3. The first connecting member 6, which is made of 0.1 mm thick substrate, forms a band having a width of 1 cm and a length of 7 cm. First end of the first connecting member 6 is disposed adjacent to the third edge 2*c* of the first plate 2 and is fixed to the first edge 2*a* of the first plate 2. A second end of the first connecting member 6 is fixed to the fourth edge 3*d* of the second plate 3. Thus, the first connecting member 6 bridges between the first edge 2*a* of the first plate 2 and the fourth edge 3*d* of the second plate 3.

Similarly, the second connecting member 7, which is made of, for example but not limited to, 0.1 mm thick substrate, forms a band having a width of 1 cm and a length of 7 cm. A first end of the second connecting member 7 is disposed adjacent to the fourth edge 2*d* of the first plate 2 and is fixed to the first edge 2*a* of the first plate 2. A second end of the second connecting member 7 is fixed to the fourth edge 3*d* of the second plate 3. Thus, the second connecting member 7 bridges between the first edge 2*a* of the first plate 2 and the fourth edge 3*d* of the second plate 3.

The third connecting member 8, which is made of 0.1 mm thick substrate, forms a band having a width of 8 cm and a length of 7 cm. The third connecting member 8 is disposed between the first connecting member 6 and the second connecting member 7. One end of the third connecting member 8 is fixed to the second edge 2*b* of the first plate 2; and the other end of the third connecting member 8 is fixed to the third edge 3*c* of the second plate 3. Thus, the third connecting member 8 bridges between the second edge 2*b* of the first plate 2 and the third edge 3*c* of the second plate 3. The substrate of the first, second and third connecting members 6-8 includes, but not limited to, synthetic resin or paper.

Six stacks of sheets 9*a*-9*f* are housed within the first housing recess 4. If desired, each stack can be of different colors. A plurality of sheets S1 having adhesive applied to their rear surfaces are stacked together to form each of the stacks 9*a*-9*f*. Two stacks 10*a*, 10*b* are housed within the second housing recess 5. If desired, the stacks 10*a* and 10*b* can be of different colors. A plurality of sheets S2 such as tags having adhesive applied to their rear surfaces are stacked together to form each of the stacks 10*a*, 10*b*. The sheets S1 or S2 can be made of a paper or polymeric film. Suitable sheets include the Post-it® Flags or Post-it® Notes (repositionable notes), commercially available from 3M Company, St. Paul, Minn.

The constructed housing container 1 is of the front and rear opening type and can carry different types of stacks 9*a*-9*f*, 10*a*, and 10*b*. As shown in FIG. 2, when the housing container 1 is opened so that the first edge 2*a* of the first plate 2 and the third edge 3*c* of the second plate 3 are apart from each other, the first housing recess 4 of the first plate 2 and the stacks 9*a*-9*f* housed in the recess 4 appears. As shown in FIG. 3, when the housing container 1 is opened so that the second edge 2*b* of the first plate 2 and the fourth edge 3*d* of the second plate 3 are apart from each other, the first housing recess 5 of the second plate 3 and the stacks 10*a* and 10*b* housed in the recess 5 appears. In addition, because the container is freely openable and closable, there will be no incidents of the tags' (S1, S2) being inadvertently creased or damaged. Further, the container 1 of the front and rear side opening type can be attained from a simple construction and can easily be made compact and light-weight.

The third connecting member 8 extends as if to hang over the first and second housing recesses 4, 5. The first connecting member 6 that abuts against the third connecting member 8 is substantially equal in width to the width of a frame surface 12 elongating along the third edge 2*c* at a short side of the first plate 2, as well as to the width of a frame surface 13 elongating along the first edge 3*a* at a short side of the second plate 3. Therefore, the first connecting member 6 can be present to extend without protruding from the first and second plates 2, 3 so that it will not hang over the first and second housing recesses 4, 5.

The second connecting member 7 that abuts against the third connecting member 8 is substantially equal in width to the width of a frame surface 14 elongating along the fourth edge 2*d* at a short side of the first plate 2, as well as to the width of a frame surface 15 elongating along the second edge 3*b* at a short side of the second plate 3. Therefore, the second connecting member 7 can be present to extend without protruding from the first and second plates 2, 3 so that it will not hang over the first and second housing recesses 4, 5. Accordingly, the first and second housing recesses 4, 5 will have opening areas for housing the stacks which will not be obstructed by the first and second connecting members 6, 7. The first and second connecting members 6, 7 will not obstruct the sheets or tags S1, S2 from being dispensed. The third connecting member 8 also serves as a blind against the stacks on the opposite side.

A hook-and-loop fastener can be applied to the first and second plates 2, 3 securing them together during transport. As shown in FIG. 2, a tape F1 having a loop portion at its tip is attached to an end of the first plate 2, and a hook portion is provided on the side of the second plate 3. As shown in FIG. 3, a tape F2 having a loop portion at its tip is attached to an end of the second plate 3, and a hook portion is provided on the side of the first plate 2.

When a magnet is used, the magnet is placed on the side of the first edge 2*a* of the first plate 2 and a metal plate made of magnetic material is placed on the side of the third edge 3*c* of the second plate 3; alternatively, the magnet is placed on the side of second edge 2*b* of the first plate 2 and a metal plate made of magnetic material is placed on the side of the fourth edge 3*d* of the second plate 3. Further, in a configuration where the first and second plates 2, 3 are brought into close contact with each other, the housing container 1 can be fastened using a strap band made of elastic material such as rubber, cloth or synthetic resin so that the first and second plates 2, 3 may not open. In this instance, a part of the band may be temporarily attached to the first plate 2 or the second plate 3 with the aid of adhesive.

One procedure for fabricating a housing container 1 will be explained.

Figure 4:
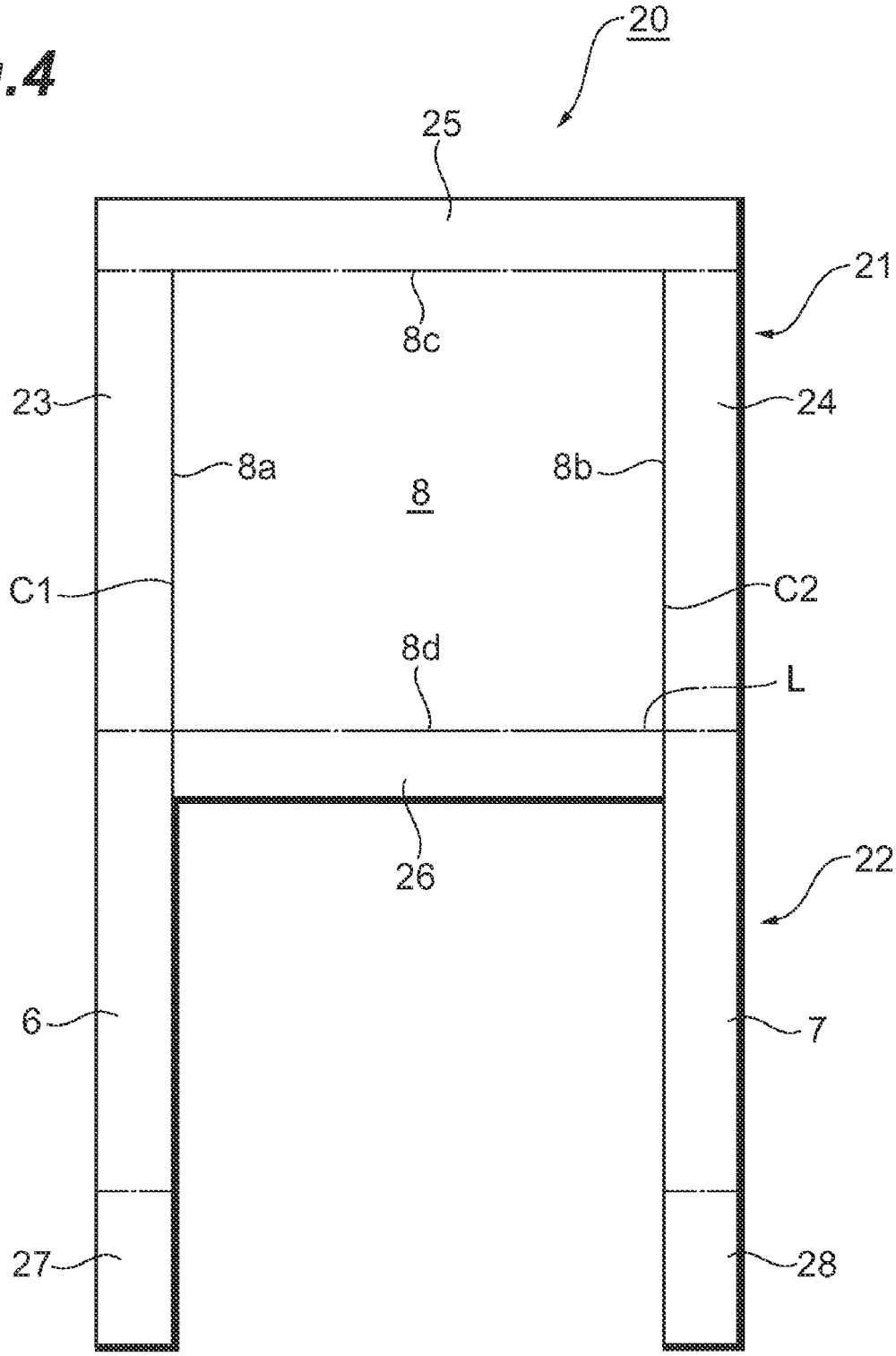
FIG. 4 is a plan view of a connecting sheet that comprises one component of the embodiment showing in FIG. 1.

Referring to FIG. 4, a 0.1 mm thick connecting sheet 20 made of a substrate, such as, but not limited to, synthetic resin or paper having high tensile strength is prepared. This connecting sheet 20 is formed by cutting out a one-piece sheet. In an extended configuration, the connecting sheet 20 is composed of a first half sheet section 21 and a second half sheet section 22 that are defined by a boundary L. The first half sheet section 21 includes a third substantially rectangular connecting member 8; a first affixing section 23 and a second affixing section 24, each of a band shape disposed along opposing, parallel first periphery 8*a* and second periphery 8*b* of the third connecting member 8; and a third affixing section 25 of a band shape for connecting the first affixing section 23 and the second affixing section 24, the third affixing section 25 disposed along a third periphery 8*c* between the first periphery 8*a* and the second periphery 8*b*.

Figure 5:
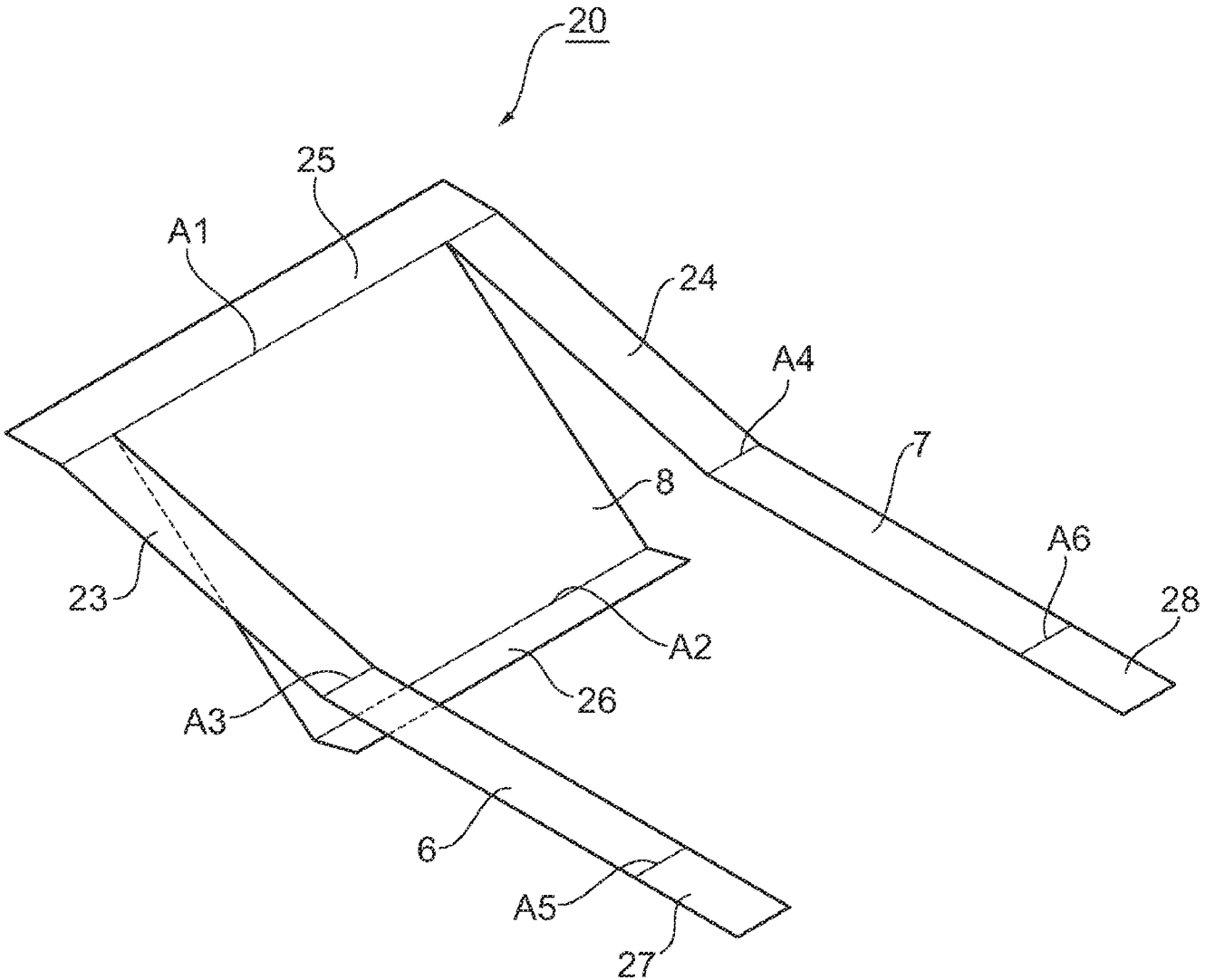
FIG. 5 is a perspective view of the connecting sheet that comprises one component of the embodiment showing in FIG. 1.

The second half sheet section 22 includes: a fourth affixing section 26 of a band shape disposed along a fourth periphery 8*d* between the first periphery 8*a* and the second periphery 8*b*; a first connecting member 6 and a second connecting member 7, each of a band shape, disposed in the same direction as that of the first and second affixing sections 23, 24. The connecting members 6, 7 are attached to an end of each of the first and second affixing sections 23, 24. A fifth affixing section 27 and a sixth affixing section 28 are attached to the other ends of the first and second connecting members 6, 7. A linear slit C1 is present between the first periphery 8*a* of the third connecting member 8 and the first affixing section 23, as well as between the first connecting member 6 and one end of the fourth affixing section 26. A linear slit C2 is present between the second periphery 8*b* of the third connecting member 8 and the second affixing section 24, as well as between the second connecting member 7 and the other end of the fourth affixing section 26. As shown in FIG. 5, this connecting sheet 20 is fold outward or inward by broken lines A1-A6.

One procedure for fabricating an openable/closable plate assembly 30 will next be described.

Figure 6:
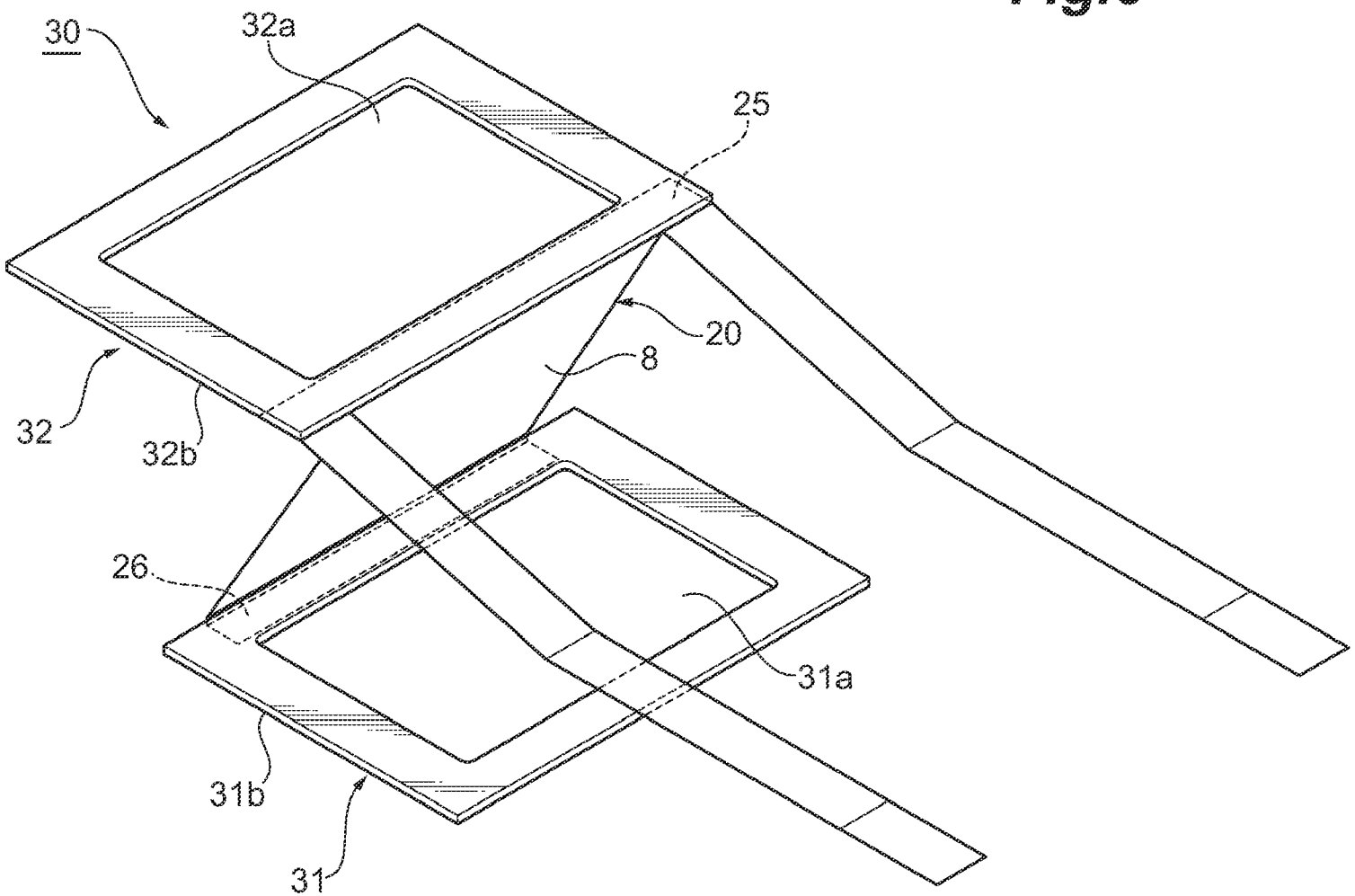
FIG. 6 is a perspective view showing an openable/closable plate assembly that comprises the connecting sheet of FIG. 5, a first frame and a second frame.
Figure 7:
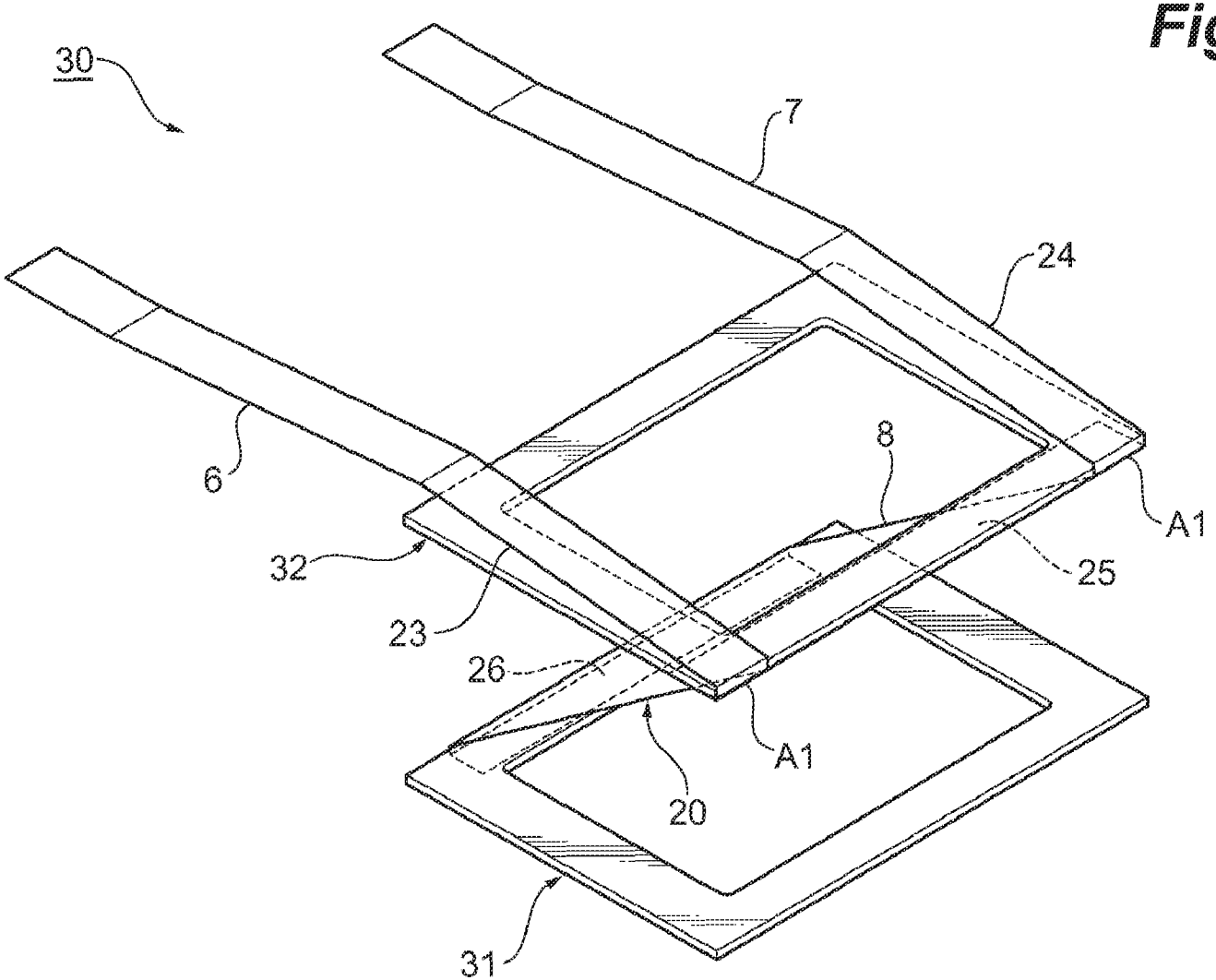
FIG. 7 is a perspective view showing a configuration where affixing sections of the connecting sheet are folded back relative to FIG. 6.
Figure 8:
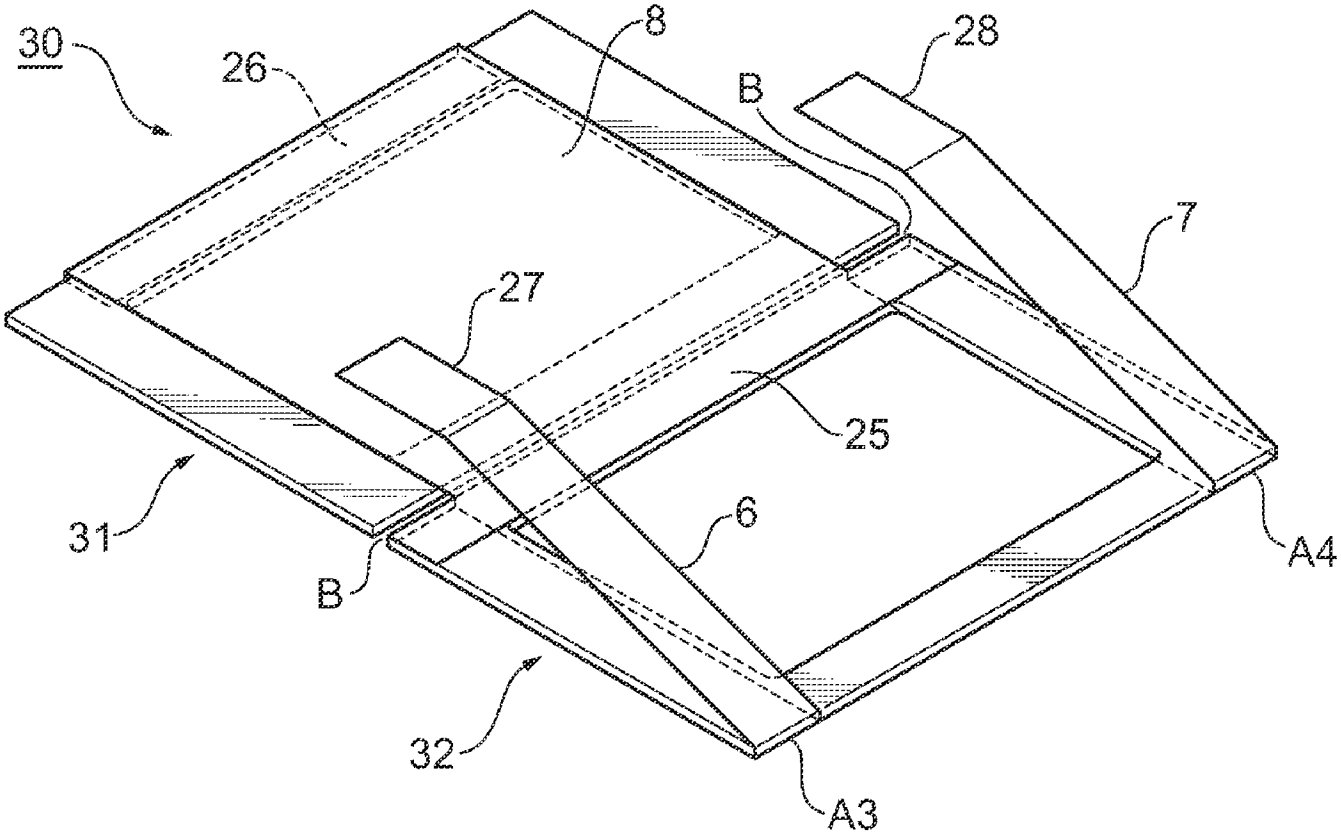
FIG. 8 is a perspective view showing a configuration where a first and a second connecting members of the connecting sheet of the openable/closable plate assembly are folded back relative to FIG. 6 and FIG. 7.
Figure 9:
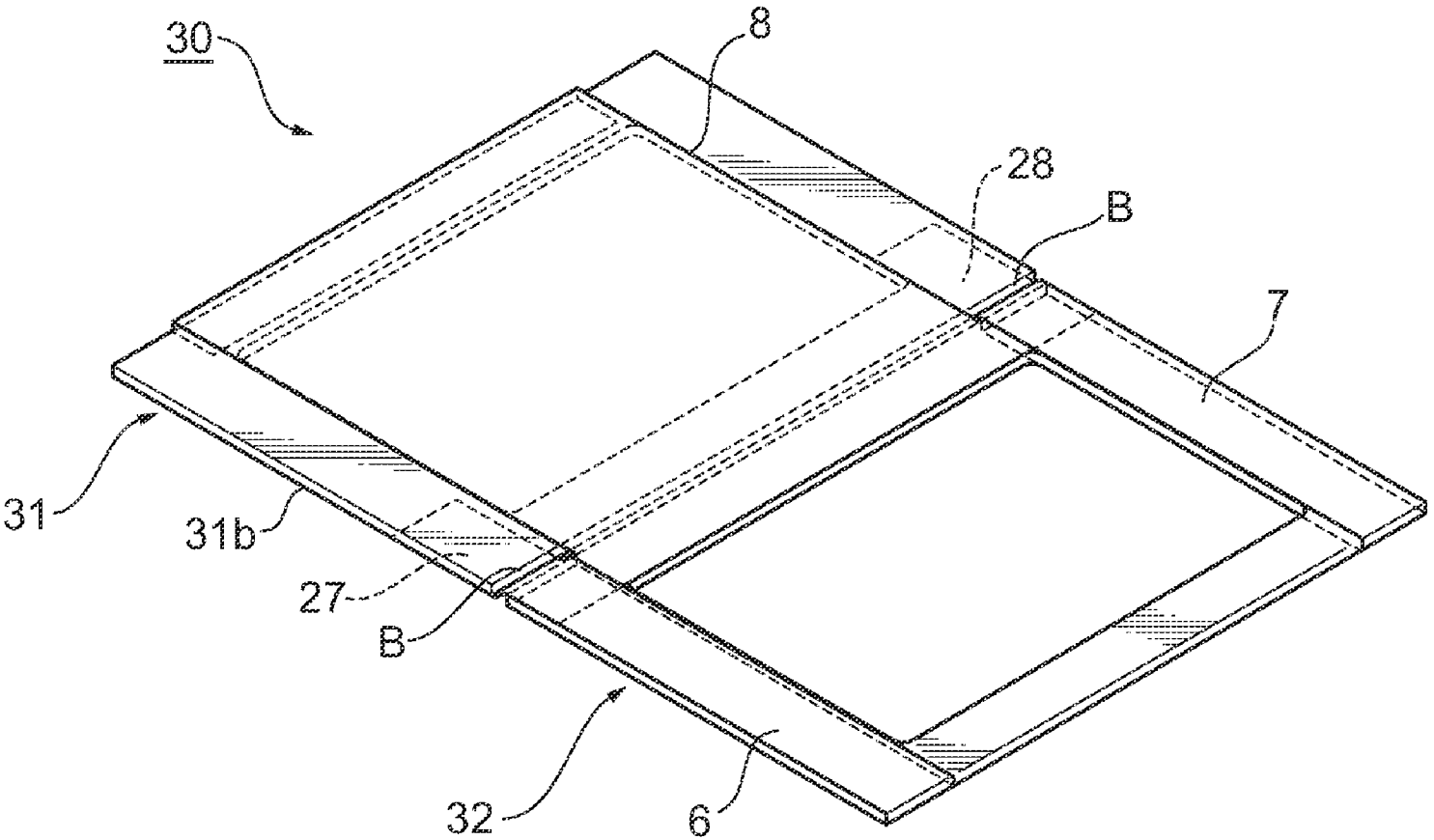
FIG. 9 is a perspective view showing a configuration where the openable/closable plate assembly has fixed relative to FIG. 6 through FIG. 8.

As shown in FIG. 6, an openable/closable plate assembly 30 comprises a first substantially rectangular frame 31 having a first opening 31*a*, a second substantially rectangular frame 32 having a second opening 32*a*, and a connecting sheet 20. The fourth affixing section 26 of the connecting sheet 20 is affixed onto a rear surface 31*b* of the first frame 31, and the third affixing section 25 of the connecting sheet 20 is affixed onto a rear surface 32*b* of the second frame 32. As shown in FIG. 7, the first and second affixing sections 23, 24 are folded back at the broken line A1 of the connecting sheet 20 and the first and second affixing sections 23, 24 are affixed to the second frame 32. As shown in FIG. 8, the first and second connecting members 6, 7 are folded back at the broken lines A3, A4 of the connecting sheet 20. As shown in FIG. 9, the fifth and the sixth affixing sections 27, 28 are inserted into a gap B between the first frame 31 and the second frame 32, and the fifth and the sixth affixing sections 27, 28 are affixed onto the rear surface 31*b* of the first frame 31. This procedure will complete the openable/closable plate assembly 30.

Figure 10:
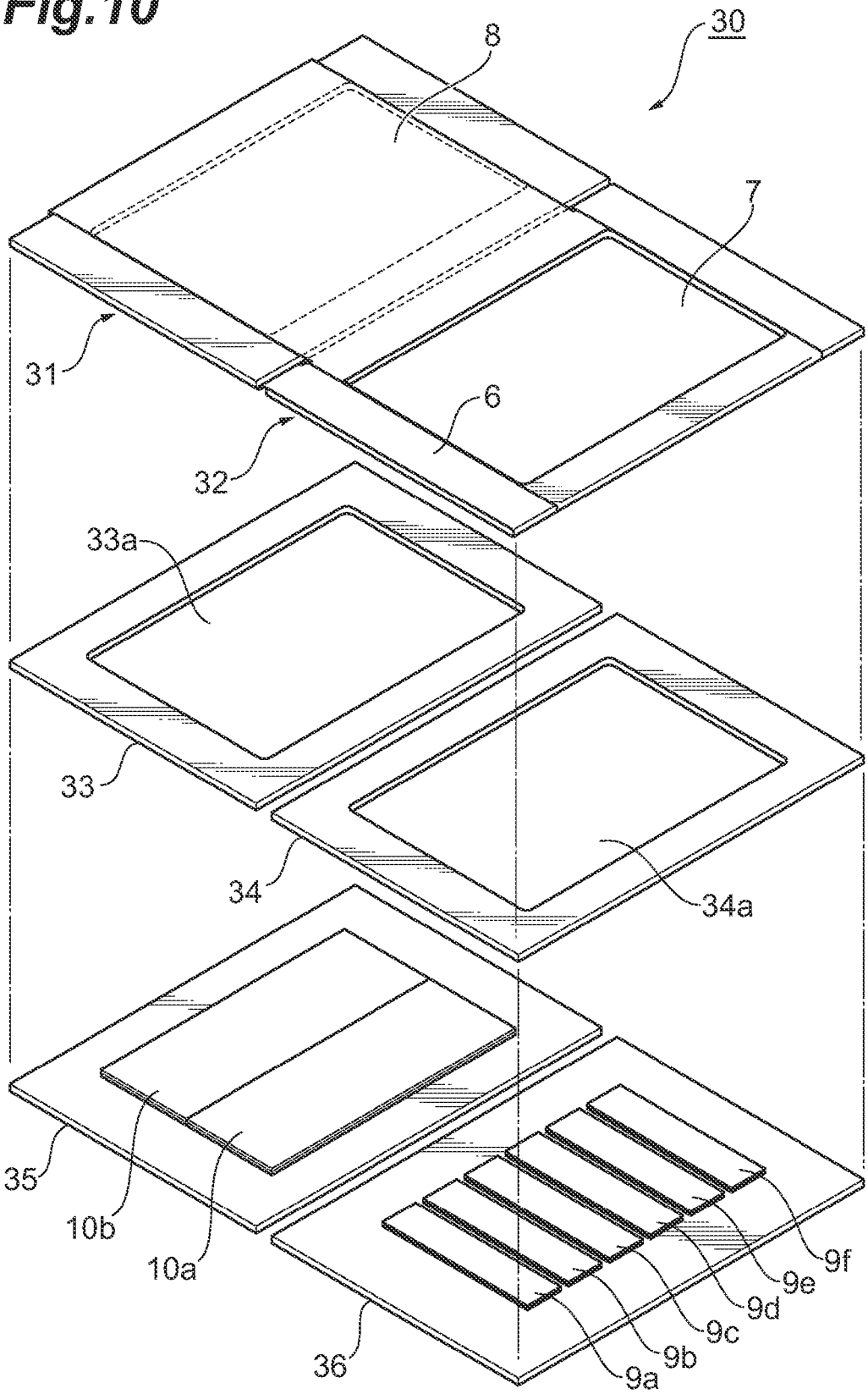
FIG. 10 is an exploded perspective view of the housing container in accordance with the embodiment showing in FIG. 1.

Referring to FIG. 10, there are prepared a height-adjusting frame 33 having an opening 33*a* and a height-adjusting frame 34 having an opening 34*a*, which have the same shapes as do the first and second frames 31, 32, a first base plate 35 having stacks 10*a*, 10*b* adhered thereto, and a second base plate 36 having stacks 9*a*-9*f* adhered thereto. The first height-adjusting frame 33 is affixed to the first frame 31 and the second height-adjusting frame 34 is affixed to the second frame 32. Subsequently, the first base plate 35 is affixed to the first height-adjusting frame 33 and the second base plate 36 is affixed to the second height-adjusting frame 34. Thus, the portable housing container 1 shown in FIGS. 1-3 will be completed.

The height-adjusting frame 33 and the first base plate 35 can be formed from, but are not limited to, resin, paper or metal in a one-piece construction, which may also be used. Similarly, the height-adjusting frame 34 and the second base plate 36 can be formed from, but are not limited to, resin, paper or metal in a one-piece construction, which may also be used.

Figure 11:
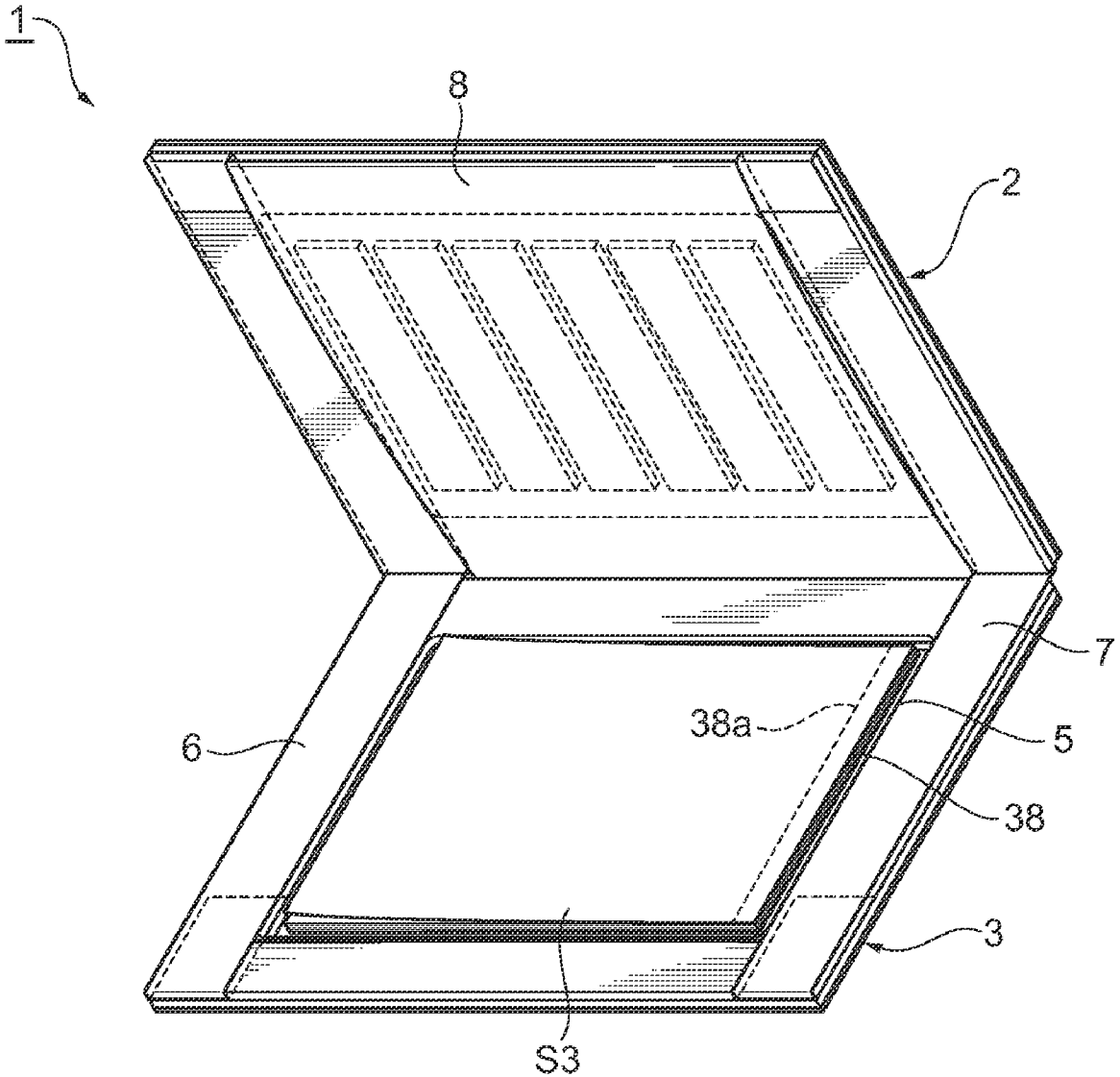
FIG. 11 is a perspective view of a housing container with stacks of sheets being fixed thereto which are different from those shown in the above figures.

Referring to a portable housing container 1 shown in FIG. 11, a stack 38 of sheets, such as, e.g., memo papers S3 is housed within the second housing recess 5 of the second plate 3. This stack 38 is adhered and fixed to the bottom surface of the second housing recess 5, and a perforation 38*a* is formed in the stack to facilitate tearing off the memo papers S3.

Figure 12:
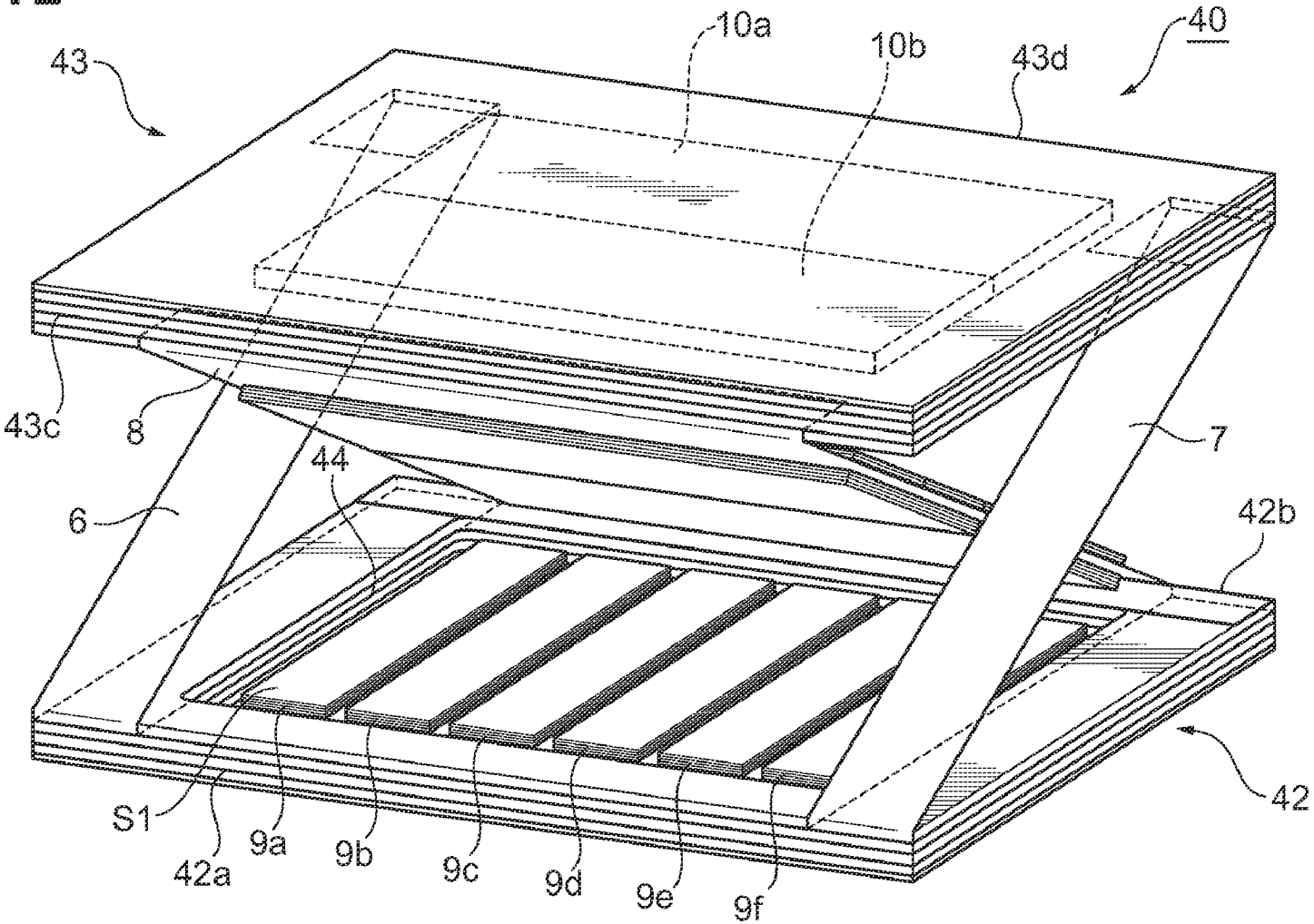
FIG. 12 is a perspective view of a portable housing container in accordance with a second embodiment of the present invention.
Figure 13:
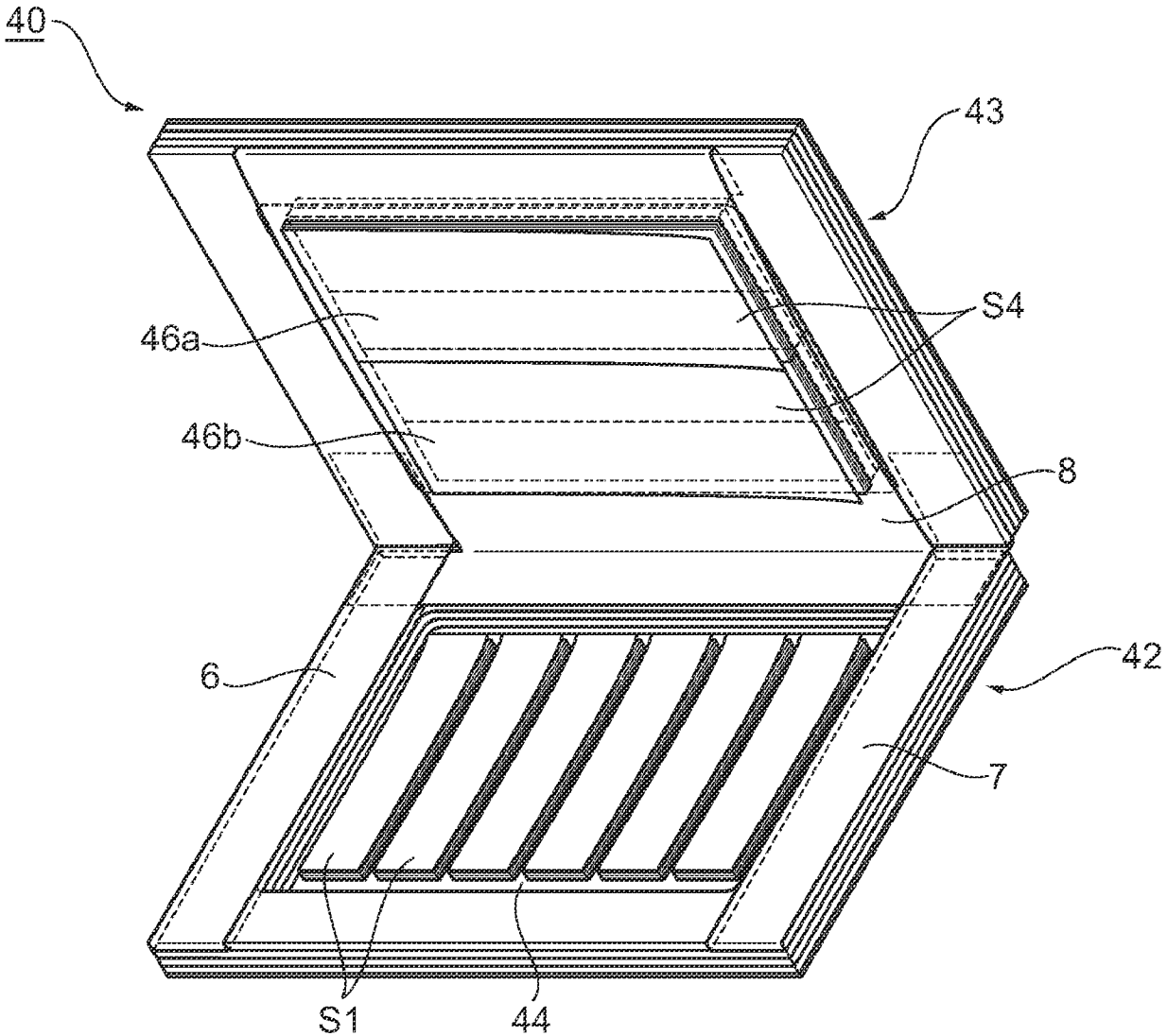
FIG. 13 is a perspective view of the housing container of FIG. 12 showing its configuration as being opened from one side.
Figure 14:
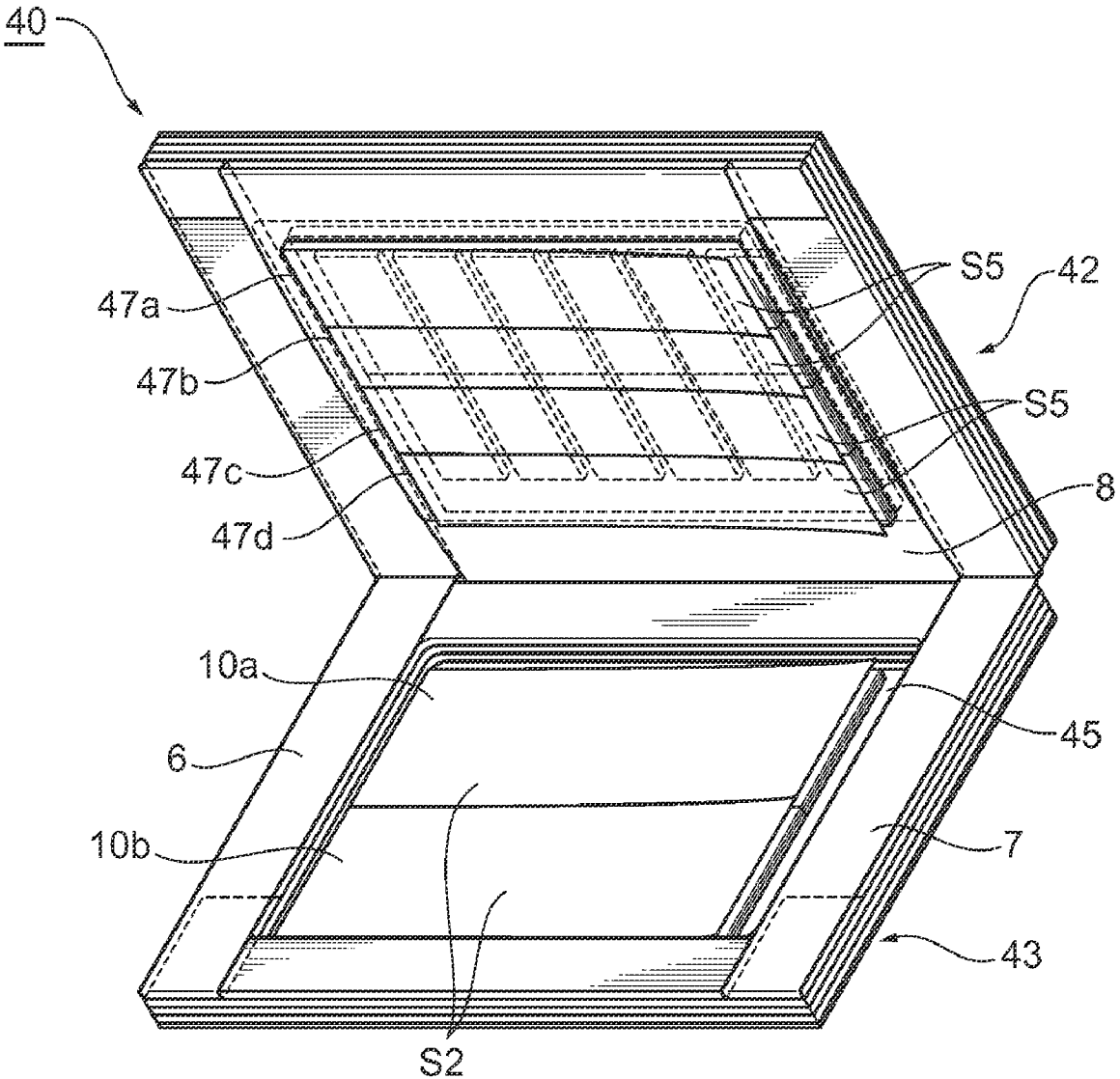
FIG. 14 is a perspective view of the housing container of FIG. 12 showing its configuration as being opened from the other side.

A second embodiment of a portable housing container according to the invention is illustrated in FIGS. 12-15. FIGS. 12-14 show a portable housing container 40 in accordance with the second embodiment. A first connecting member 6 and a second connecting member 7, which are provided in the housing container 40, are bridged between a first edge 42*a* of a first plate 42 and a fourth edge 43*d* of a second plate 43. Further, a third connecting member 8 is disposed between the first connecting member 6 and the second connecting member 7 and is bridged between a second edge 42*b* of the first plate 42 and a third edge 43*c* of the second plate 43.

Six stacks 9*a*-9*f* are housed within the first housing recess 44. If desired, each stack can be of different colors. A plurality of sheets S1 having adhesive applied to their rear surfaces are stacked together to form each of the stacks 9*a*-9*f*. Two stacks 10*a*, 10*b* are housed within the second housing recess 45. If desired, the stacks 10*a* and 10*b* can be of different colors. A plurality of sheets S2, such as tags, having adhesive applied to their rear surfaces are stacked together to form each of the stacks 10*a*, 10*b*. The sheets S1 or S2 can be made of a paper or polymeric film. Suitable sheets include the Post-it® Flags or Post-it® Notes (repositionable notes), commercially available from 3M Company.

Stacks 46*a* and 46*b* are fixed onto one surface of a third connecting member 8 with the aid of adhesive. Sheets S4 (such as, e.g., tags) having adhesive applied to their rear surfaces are stacked together to form each of the stacks 46*a*, 46*b*. Four stacks 47*a*-47*d* are fixed onto the other surface of the third connecting member 8 with the aid of adhesive. If desired, each stack can be of different colors. Sheets S5 (such as, e.g., tags) having adhesive applied to their rear surfaces are stacked together to form each of the stacks 47*a*-47*d*. Suitable sheets include the Post-it® Flags or Post-it® Notes (repositionable notes), commercially available from 3M Company.

Figure 15:
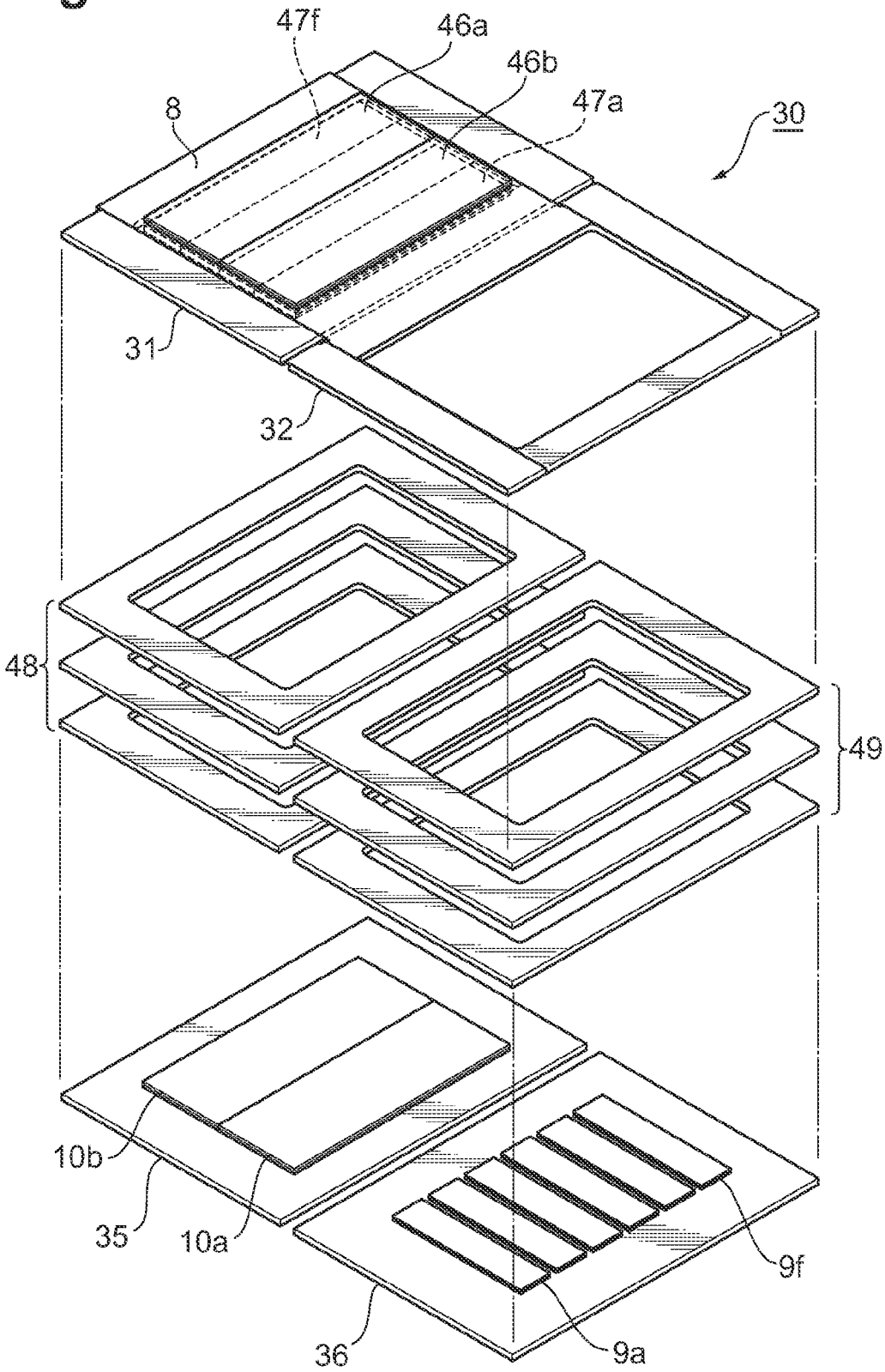
FIG. 15 is an exploded perspective view of the housing container in accordance with the second embodiment.

As shown in FIG. 15, three sheets of height-adjusting frames 48 are inserted between a first frame 31 of an openable/closable plate assembly 30 where the stacks 46*a*, 46*b*, and 47*a*-47*d* are fixed to the third connecting member 8 and a first base plate 35. Three sheets of height-adjusting frames 49 are inserted between a second frame 32 of the openable/closable plate assembly 30 and a second base plate 36. This arrangement can increase the volumes of the first and second housing recesses 44, 45 so as to house the stacks 46*a*, 46*b*, and 47*a*-47*d*.

The height-adjusting frame 48 and the first based plate 35 are formed from resin, paper or metal in a one-piece construction, which may also be used. Similarly, the height-adjusting frame 49 and the second based plate 36 are formed from resin, paper or metal in a one-piece construction, which may also be used.

Figure 16:
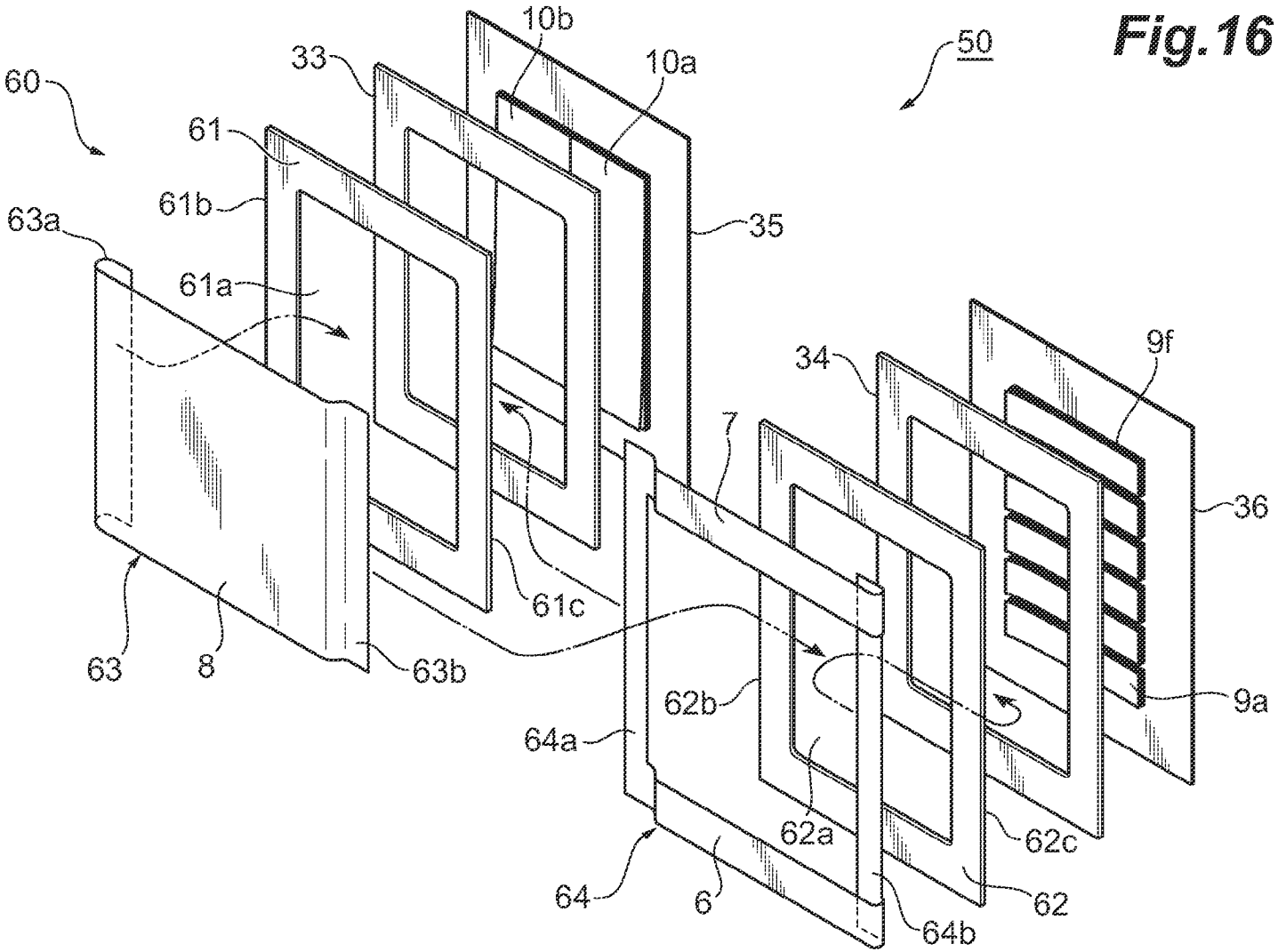
FIG. 16 is an exploded perspective view of a portable housing container in accordance with a third embodiment of the present invention.
Figure 17:
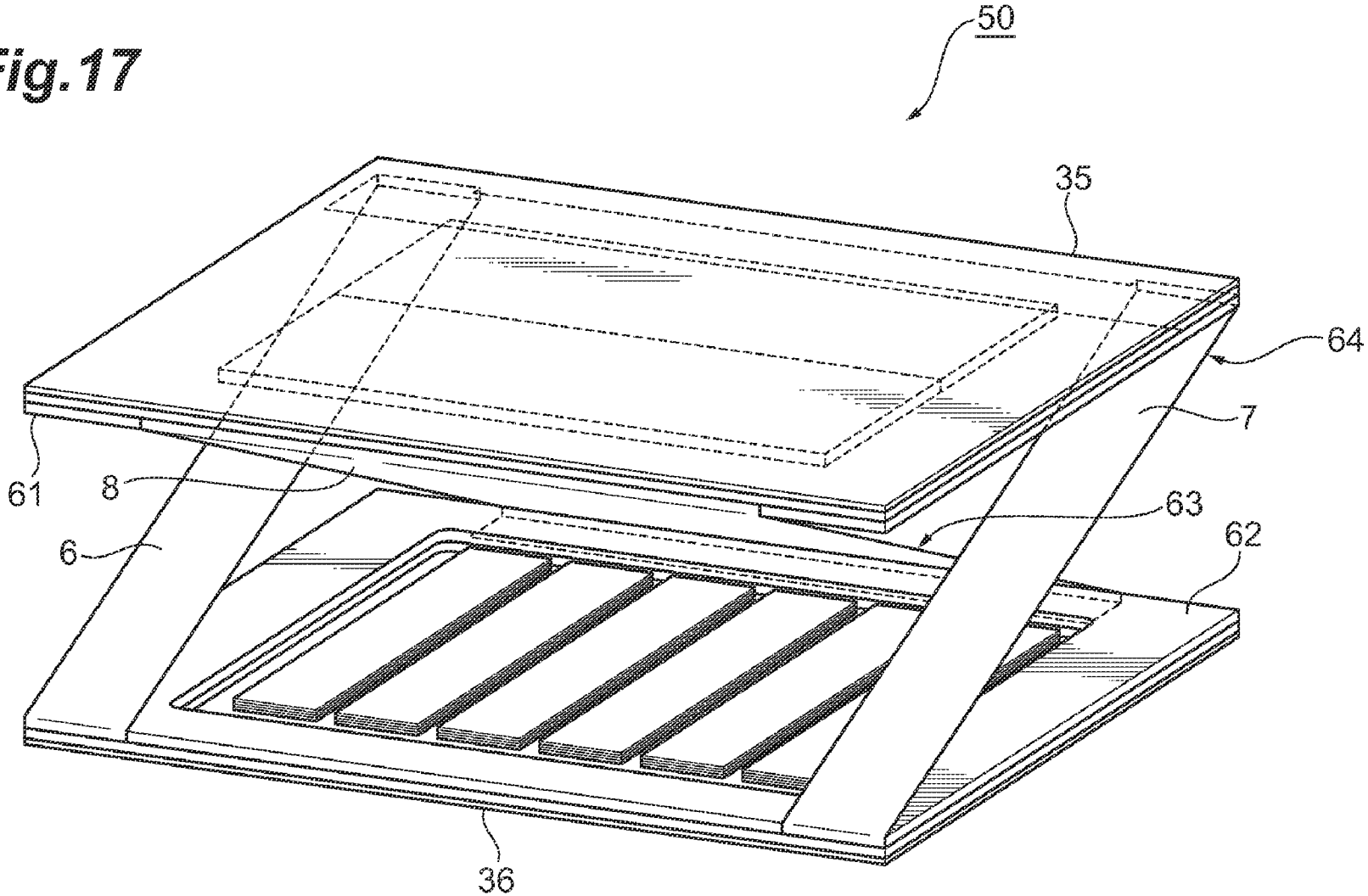
FIG. 17 is a perspective view of the housing container of FIG. 16.
Figure 18:
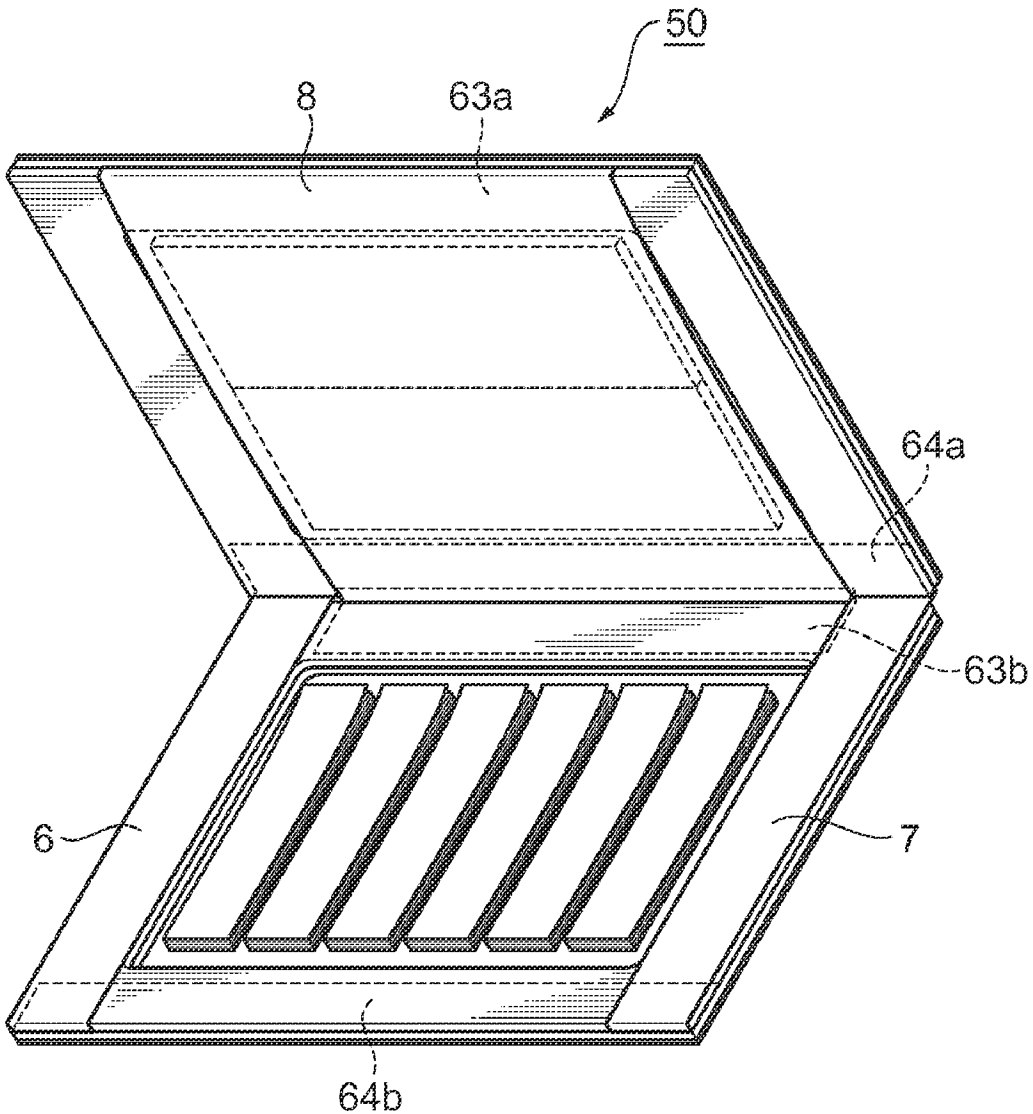
FIG. 18 is a perspective view of the housing container of FIG. 16 showing its configuration as being opened from one side.
Figure 19:
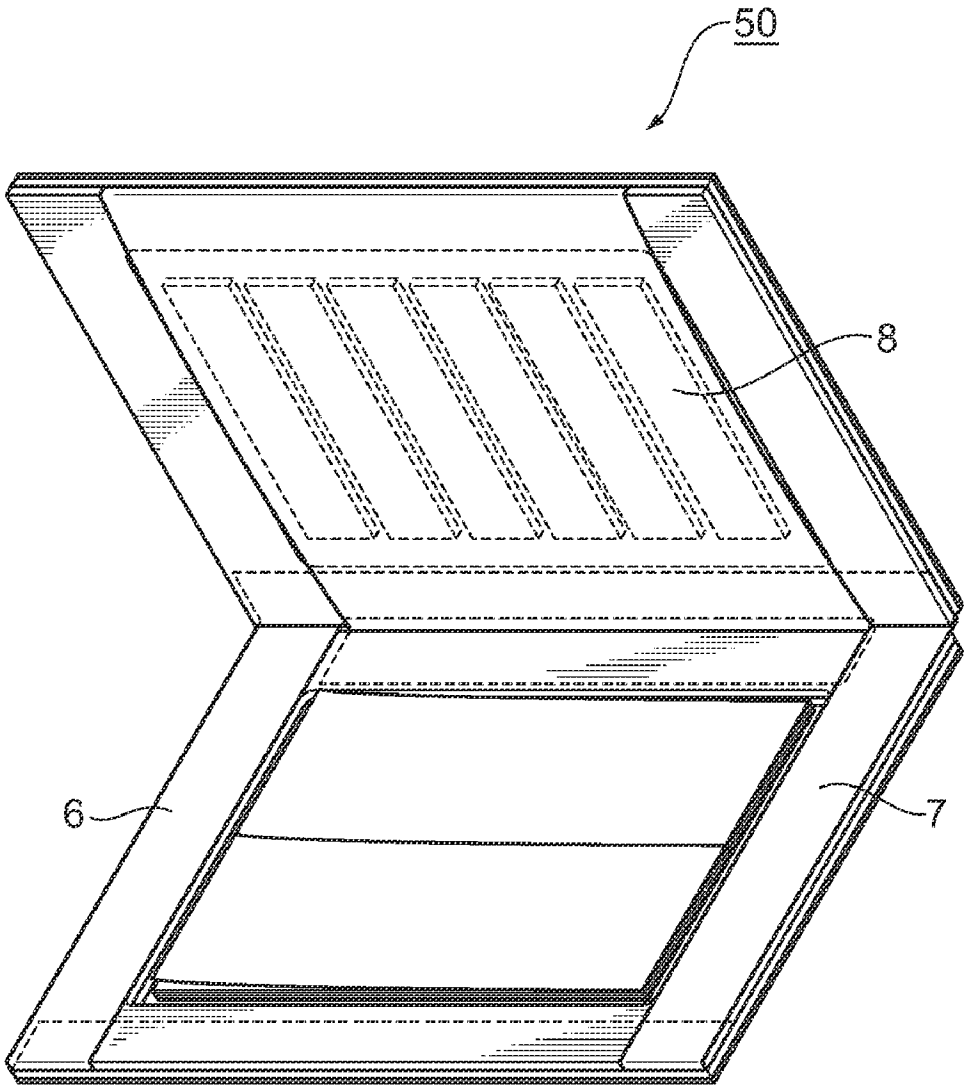
FIG. 19 is a perspective view of the housing container of FIG. 16 showing its configuration as being opened from the other side.
Figure 20:
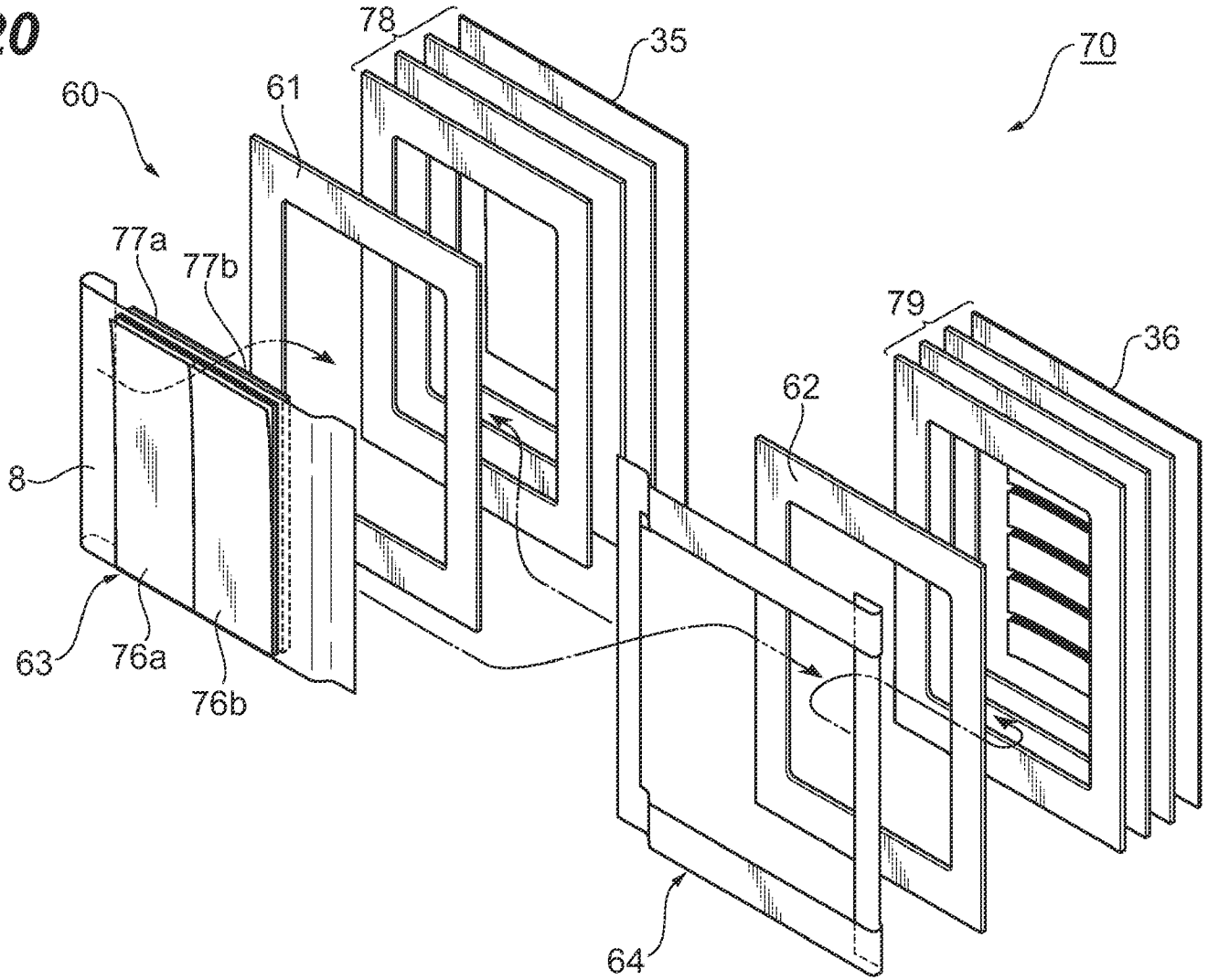
FIG. 20 is an exploded perspective view of a portable housing container in accordance with a fourth embodiment of the present invention.
Figure 21:
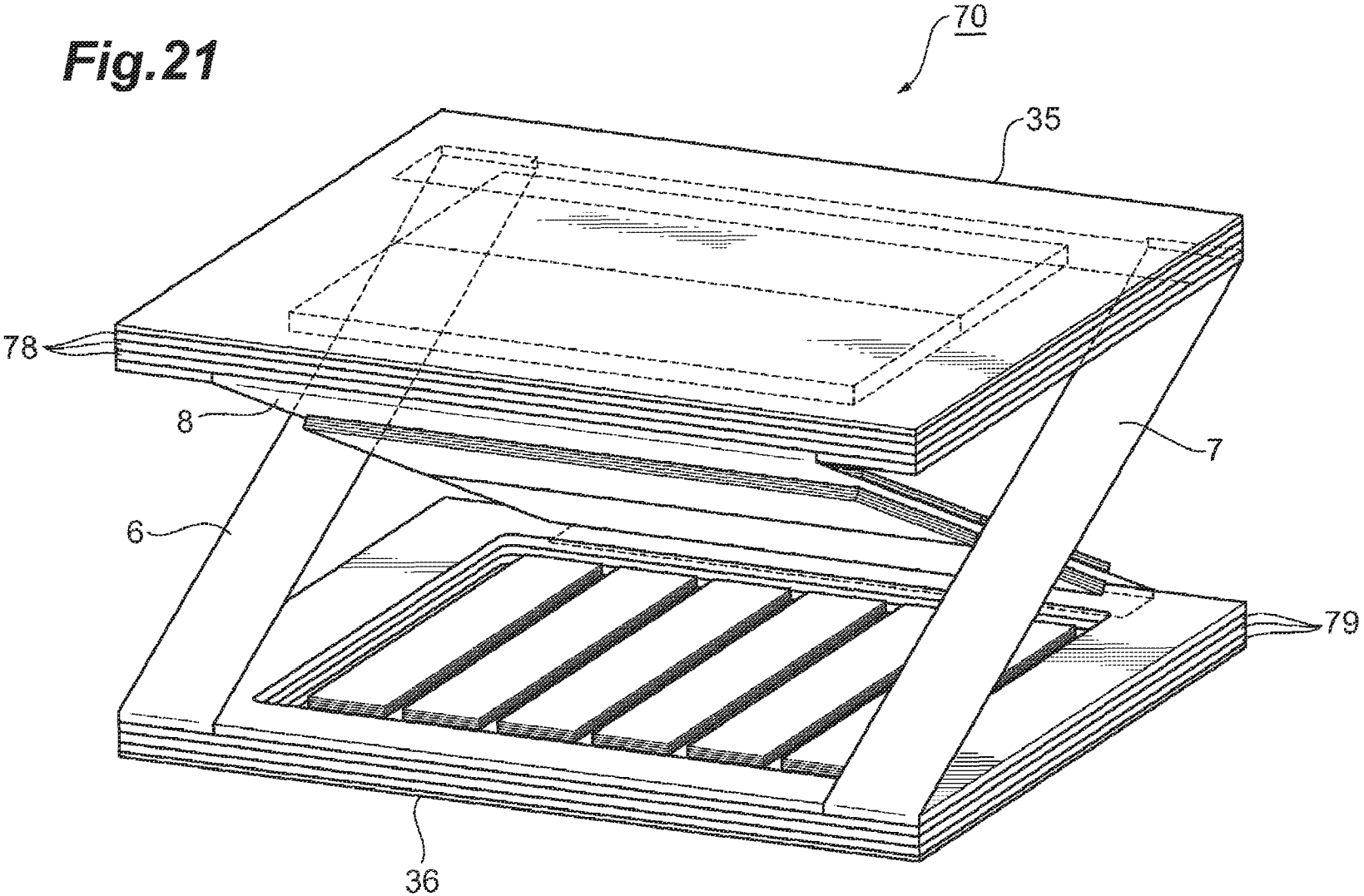
FIG. 21 is a perspective view of the housing container of FIG. 20.
Figure 22:
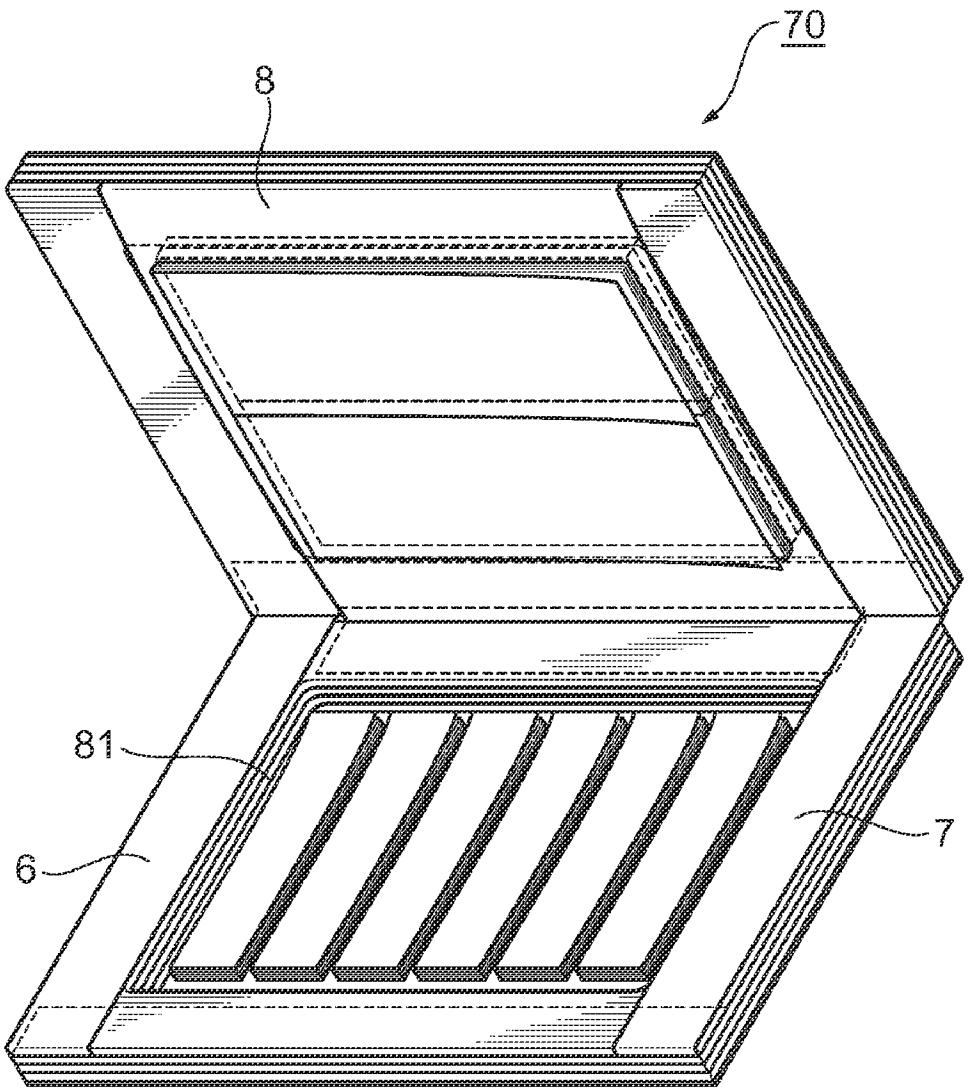
FIG. 22 is a perspective view of the housing container of FIG. 20 showing its configuration as being opened from one side.
Figure 23:
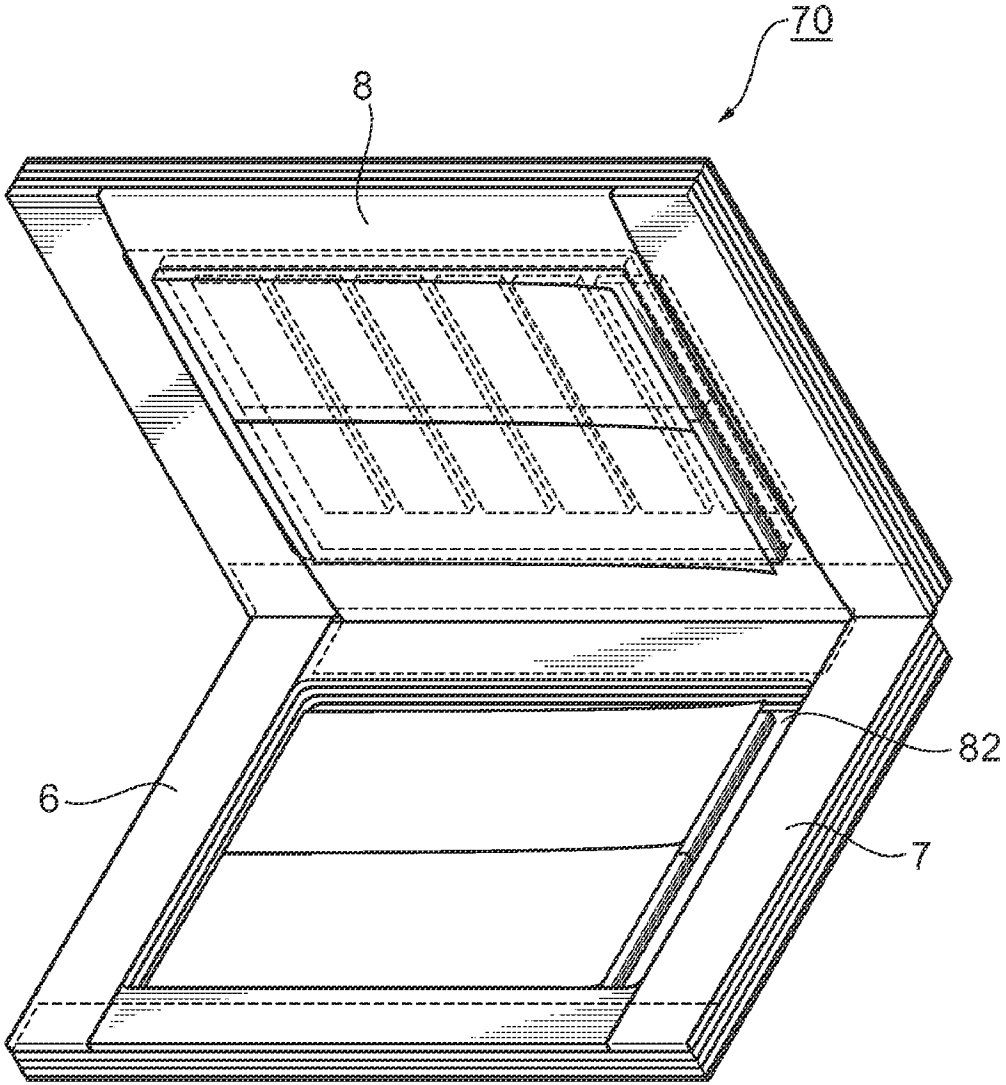
FIG. 23 is a perspective view of the housing container of FIG. 20 showing its configuration as being opened from the other side.

A third embodiment of a portable housing container according to the invention is illustrated in FIGS. 16-19. As shown in FIG. 16, an openable/closable plate assembly 60 of a portable housing container 50 in accordance with a third embodiment comprises a first frame 61 of a rectangular shape having an opening 60*a*, a second frame 62 of a rectangular shape having an opening 62*a*, a first connecting sheet 63 forming a rectangular plane, and a second connecting sheet 64 forming a rectangular frame. A first affixing section 63*a* and a second affixing section 63*b* are provided at both ends of the first connecting sheet 63. The second connecting sheet 64 is provided with a first and a second connecting members 6,7 that are parallel to each other, and with a third affixing section 64*a* and a fourth affixing section 64*b* that are parallel to each other and are bridged between the first connecting member 6 and the second connecting member 7.

The first affixing section 63*a* of the first connecting sheet 63 is fixed onto the rear surface of the first frame 61 at its long side edge 61*b* with the aid of adhesive. The second affixing section 63*b* of the first connecting sheet 63 is fixed onto the rear surface of the second frame 62 at its long side edge 62*b* with the aid of adhesive. The third affixing section 64*a* of the second connecting sheet 64 is fixed onto the rear surface of the first frame 61 at its long side edge 61*c* with the aid of adhesive. The fourth affixing section 64*b* of the second connecting sheet 64 is fixed onto the rear surface of the second frame 62 at its long side edge 62*c* with the aid of adhesive.

One sheet of height-adjusting frame 33 is inserted between the first frame 61 and the first base plate 35 in the openable/closable plate assembly 60, and one sheet of height-adjusting frames 34 is inserted between the second frame 62 and the second base plate 36 in the openable/closable plate assembly 60. Thus, the fabrication of the portable housing container 50 shown in FIGS. 17-19 will be completed.

A fourth embodiment of a portable housing container according to the invention is illustrated in FIGS. 20-23. FIGS. 20-23 show a portable housing container 70 in accordance with the fourth embodiment. Stacks 76*a* and 76*b* are fixed onto one surface of a third connecting member 8 with the aid of adhesive. If desired, each stack can be of different color. Stacks 77*a* and 77*b* are fixed onto the other surface of the third connecting member 8 with the aid of adhesive. Suitable sheets include the Post-it® Flags or Post-it® Notes (repositionable notes), commercially available from 3M Company.

Three sheets of height-adjusting frames 78 are inserted between a first frame 61 and a first base plate 35 in an openable/closable plate assembly 60, and three sheets of height-adjusting frames 79 are inserted between a second frame 62 and a second base plate 36 in the openable/closable plate assembly 60. This arrangement can increase the volumes of a first and a second housing recesses 81, 82 so as to house the stacks 76*a*, 76*b*, 77*a* and 77*b* that are fixed to the third connecting member 8.

The housing containers 1, 40, 50 and 70 are not limited to the various embodiments described above and may be of any portable size that may be suitable for use, such as a pocket note book size, B5 size or A4 size.

What is claimed is:

1. A portable housing container comprising:

a substantially rectangular first plate having a first housing recess, the first plate having opposing first and second edges;

a substantially rectangular second plate having a second housing recess, the second plate having a third edge facing the first edge of the first plate and a fourth edge facing the second edge of the first plate; and a connecting sheet comprising a first connecting member, a second connecting member and a third connecting member for connecting the first plate and the second plate, each connecting member being disposed between the first plate and the second plate, wherein the first connecting member and the second connecting member are bridged between the first edge of the first plate and the fourth edge of the second plate, and the third connecting member, while being disposed between the first connecting member and the second connecting member, is bridged between the second edge of the first plate and the third edge of the second plate, and wherein the connecting sheet comprises: a first half sheet portion comprising the third connecting member of a rectangular shape, a first and a second affixing sections elongating along a first and a second peripheries of the third connecting member that are parallel and opposed to each other, the first and second affixing sections each having first and second ends, and a third affixing section for connecting the first and second affixing sections, the third affixing section disposed along a third periphery between the first periphery and the second periphery; and a second half sheet portion comprising a fourth affixing section disposed along a fourth periphery between the first periphery and the second periphery, the first and second connecting members disposed in the same direction as the first and second affixing sections, the connecting members being attached to the first and second affixing sections at the first ends thereof, and a fifth and a sixth affixing sections being attached to the second ends of the first and second connecting members, wherein slits are made between the third connecting member and the first affixing section, between the third connecting member and the second affixing section, between the first connecting member and the fourth affixing section, and between the second connecting member and the fourth affixing section.

2. The portable housing container according to claim 1, wherein the first and second plates are substantially similar in shape.

3. The portable housing container according to claim 1, wherein the third connecting member extends as if to hang over the first and second housing recesses, and the first and second connecting members, which are disposed at both sides of the third connecting member, extend without protruding from the first and second plates.

4. The portable housing container according to claim 1, wherein the first and second housing recesses are substantially rectangular in shape.

5. The portable housing container according to claim 1, wherein the second plate is detachably bound to the first plate by a binding means.

6. The portable housing container according to claim 1, wherein at least one stack of sheets is housed within at least one of the first housing recess and the second housing recess.

7. The portable housing container according to claim 6, wherein each sheet has adhesive applied to its rear surface.

* * * * *